US007195128B2

(12) United States Patent
Murakami et al.

(10) Patent No.: US 7,195,128 B2
(45) Date of Patent: Mar. 27, 2007

(54) FOLDABLE TRANSPORTATION CONTAINER

(75) Inventors: Tetsuya Murakami, Gifu (JP); Hidetoshi Yamaguchi, Gifu (JP)

(73) Assignee: Gifu Plastic Kogyo Kabushiki Gaisha, Gifu (JP)

( * ) Notice: Subject to any disclaimer, the term of this patent is extended or adjusted under 35 U.S.C. 154(b) by 95 days.

(21) Appl. No.: 11/006,178

(22) Filed: Dec. 6, 2004

(65) Prior Publication Data

US 2005/0098557 A1 May 12, 2005

Related U.S. Application Data

(63) Continuation of application No. 10/151,350, filed on May 20, 2002, now abandoned.

(51) Int. Cl.
*B65D 6/00* (2006.01)
*B65D 19/00* (2006.01)

(52) U.S. Cl. ..... 220/7; 220/4.28; 220/4.17; 206/600

(58) Field of Classification Search ..... 220/6, 220/7, 4.28, 8, 49, 4, 22, 4.17, 4.34, 849; 206/600

See application file for complete search history.

(56) References Cited

U.S. PATENT DOCUMENTS 5,632,392 A 5/1997 Oh ..... 220/7
5,853,099 A 12/1998 Lessard ..... 220/7
6,290,081 B1 9/2001 Merey ..... 220/7
6,293,418 B1 9/2001 Ogden et al. ..... 220/7
7,011,225 B2 * 3/2006 Oster et al. ..... 220/7
7,017,766 B2 * 3/2006 Hsu et al. ..... 220/7

FOREIGN PATENT DOCUMENTS

JP 63-117725 7/1998
WO 00/68099 11/2000

* cited by examiner

*Primary Examiner*—Jes F. Pascua
*Assistant Examiner*—Shawn M. Braden
(74) *Attorney, Agent, or Firm*—Robert D. Buyan; Stout, Uxa, Buyan & Mullins, LLP

(57) ABSTRACT

A foldable transportation container comprises a container body formed into a box having a rectangular bottom, and a pair of first side walls and a pair of second side walls provided along the periphery of the bottom wall, rotating means provided on the lower ends of the side walls so that the side walls can be folded inward of the container body, an engagement member provided on the outside face of the first side wall. Engagement portions are provided on both ends of each second side wall. The first side walls are folded onto the upper face of the bottom wall and then the second side walls are folded onto the first side walls. An operation portion is provided at the substantial center of each engagement member. Engagement projections are provided at the ends of each engagement member. The engagement portions are engaged with the engagement projections to limit inward rotation of the first side walls. The operation portions of the engagement members are moved up or down to release engagement between the engagement projections and the engagement portions.

11 Claims, 15 Drawing Sheets

FOLDABLE TRANSPORTATION CONTAINER

RELATED APPLICATION

This is a continuation of application Ser. No. 10/151,350 filed May 20, 2002 now abandoned which claims priority to Japanese Patent Application Nos. 2002-003739 filed on Jan. 10, 2002 and 2001-150717 filed on May 21, 2001.

BACKGROUND OF THE INVENTION

The present invention relates to a foldable transportation container that is compactly folded to be stored and carried when not in use, and more specifically to a foldable transportation container that is easy to fold.

Conventionally, as foldable transportation containers of this kind, a foldable container disclosed in Japanese Laid-Open Utility Model Publication No. Sho 63-117725 is known. This foldable container has a structure in which wall boards constituting the respective side walls are attached directly to the four sides of a rectangular bottom board or to bases formed there, so that the side walls are inwardly foldable with hinge structures at the lower sides of the side walls. Further, in this container, in adjacent sides of the wall boards adjacent to each other, constituting corners of the side wall, to any one of the sides, stop members stopped to the other side are provided to mutually limit outward openings of both of those wall boards. In addition, to one of the adjacent sides, engagement members engaged with biasing forces with engagement holes formed in the other side so as to be detachable, are provided to mutually limit inward rotations of both of those wall boards. Then, lateral slide-operation of both of the engagement members is performed against the biasing forces to release the engagement with the engagement holes, the side walls in which the engagement members are provided can be inwardly rotated and thereby the container can easily be folded.

However, in the conventional foldable container, in addition to the fact that a pair of left and right engagement members are provided at distant positions of both ends of the side wall, it was constructed so that the side wall might be folded by detaching those two engagement members from the engagement holes at once. Therefore, when the side wall is folded, the engagement state between both engagement members and engagement holes must be released by operating with both hands put on both ends of the side wall, and only one side wall can be folded once.

SUMMARY OF THE INVENTION

An object of the present invention is to provide a foldable transportation container constructed so that the folding operation can be performed still more easily.

To achieve the above object, one embodiment of the present invention provides a foldable transportation container. The container comprises a container body having a rectangular bottom wall a pair of first side walls, and a pair of second side walls. The first and second side walls are provided along the periphery of the bottom wall. The container also includes rotating means, engagement members, and engagement portions. The rotating means is provided on the lower ends of the side walls. The rotating means permits the side walls to be folded inward of the container body. The first side walls are folded onto the upper face of the bottom wall and then the second side walls are folded onto the folded first side walls. Each engagement member is provided on the outer surface of one of the first side walls. An operation portion is provided on the substantial center of each the engagement member. A projection is provided at each end of each engagement member. Engagement portions are provided on both ends of the second side walls. The engagement portions are engaged with the engagement projections to limit rotation of the first side walls inward of the container body. The operation portions of the engagement members are moved up or down to release engagement between the engagement projections and the engagement portions.

Other aspects and advantages of the present invention will be apparent from the following description together with drawings showing an example of principle of the present invention.

BRIEF DESCRIPTION OF THE DRAWINGS

Characteristic features of the present invention considered to be novel will be apparent particularly in the appended claims. The present invention with objects and advantages will be understood by referring to the description of preferred embodiments at the present as shown below with reference to accompanying drawings.

FIG. 1(*c*) is a cross-sectional view taken along the line 1*c*—1*c* of FIG. 1(*a*);

FIG. 2(*b*) is a front sectional view of the foldable transportation container;

FIG. 6(*b*) is a cross-sectional view of the long side wall;

FIG. 6(*c*) is a cross-sectional view taken along the line 6*c*—6*c* of FIG. 6(*a*);

FIG. 7(*b*) is a side view of the short side wall;

FIG. 8(*b*) is a rear view of the engagement member;

FIG. 12(*b*) is a cross-sectional view taken along the line 12*b*—12*b* of FIG. 12(*a*);

FIG. 15(*b*) is a rear view of the operation member of FIG. 15(*a*);

FIG. 16(*b*) is a bottom view of the connecting member of FIG. 16(*a*);

DETAILED DESCRIPTION OF THE PREFERRED EMBODIMENTS

Hereinafter, embodiments in which this invention is embodied will be described in detail on the basis of the drawings.

Figure 2A:
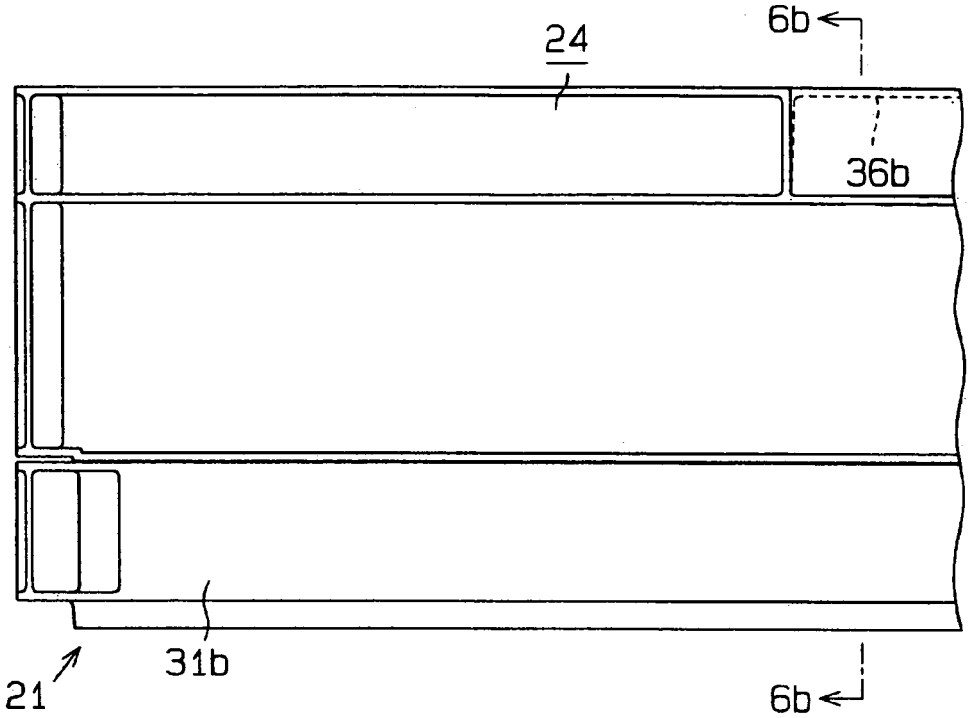
FIG. 2(*a*) is a front view showing the container body of the foldable transportation container.
Figure 2B:
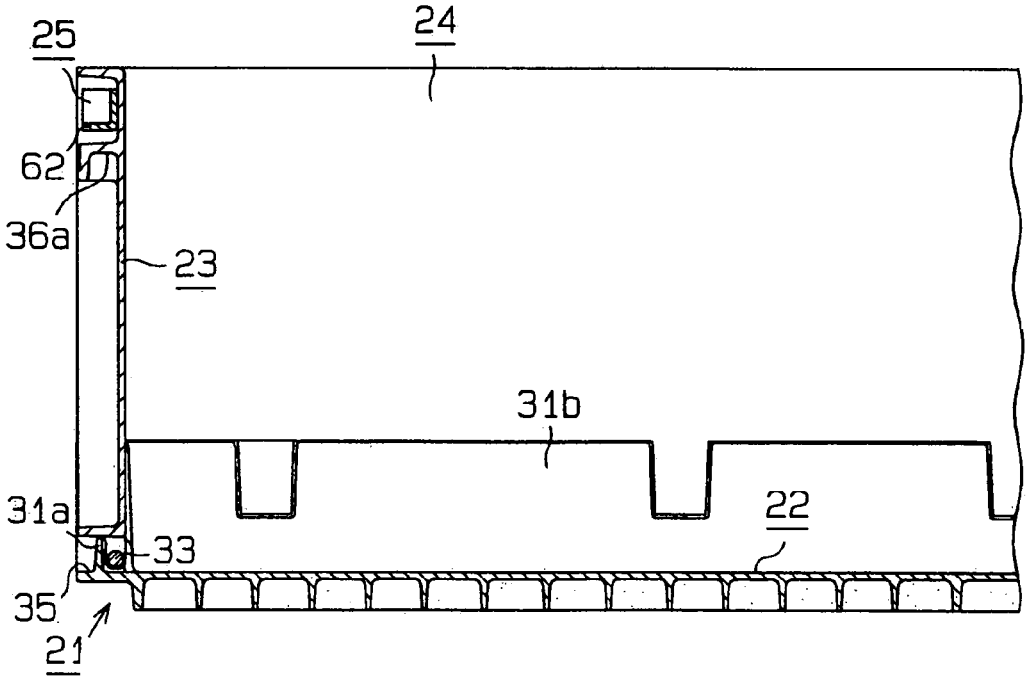
Figure 5:
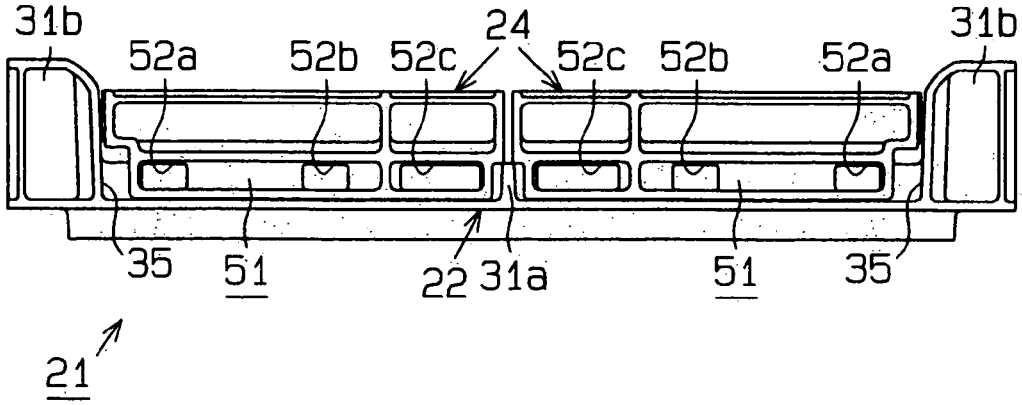
FIG. 5 is a side view showing the container body in a folded state.

As shown in FIG. 2(*a*) to FIG. 5, a container body 21 constituting a foldable transportation container is made of a synthetic resin (polypropylene) into a box with a rectangular bottom. This container body 21 comprises a rectangular bottom wall 22, a pair of short side walls 23 formed to stand along a pair of opposing sides of the bottom wall 22, and a pair of long side walls 24 formed to stand along the other opposing sides of the bottom wall 22. Further, an engagement member 25 made of a synthetic resin (polypropylene) into a substantially rectangular shape is formed to be attached to the upper end of the outside face of the short side wall 23. After a pair of short side walls 23 is folded onto the upper face of the bottom wall 22, the container body 21 of this foldable transportation container is constructed so as to be foldable by folding a pair of long side walls 24 onto the upper face of the short side wall 23.

On two opposing sides of the bottom wall 22, supporting protrusions 31*a* formed into poles having a rectangular cross-section are formed to connect pairs of the corners of the container body 21, and support the short side walls 23 by its upper end face. On the other sides of the bottom wall 22, supporting protrusions 31*b* formed into poles having a substantially rectangular cross-section are formed to connect pairs of the corners of the container body 21, and support the long side walls 24 by its upper end face. The height of the supporting protrusions 31*a* is formed so as to be substantially equal to the thickness of the short side walls 23. The supporting protrusions 31*b* are formed such that their height is substantially equal to the length that the thickness of the short side walls 23 and the thickness of the long side walls 24 are added.

At the inner position of the upper end of each supporting protrusion 31*a* or 31*b*, bearing portions 32 constituting rotating means are provided at a predetermined interval, and fit a rotational axis 33 formed at the inner position of the lower end of the short side walls 23 and the long side walls 24 and constituting rotating means. By this construction, each of the short side walls 23 and the long side walls 24 can be rotated inside the container body 21, but it is hard to rotate outside the container body 21. Further, the lower end faces of the short side walls 23 and long side walls 24 and the upper end faces of the supporting protrusions 31*a* and 31*b* each are constructed by a flat face extending horizontally, and when the container body 21 is assembled, the short side walls 23 and the long side walls 24 are easily formed to stand in a stable state on the supporting protrusions 31*a* and 31*b*.

On the other hand, in the outer sides of the supporting protrusion 31*a*, a pair of left and right receiving recesses 35 is provided. The recesses 35 are substantially rectangular. Besides, in the center of the upper end of the short side walls 23 and the long side walls 24, substantially rectangular handle holes 36*a* and 36*b* are formed, and it is constructed so as to easily hold the container body 21.

Figure 7B:
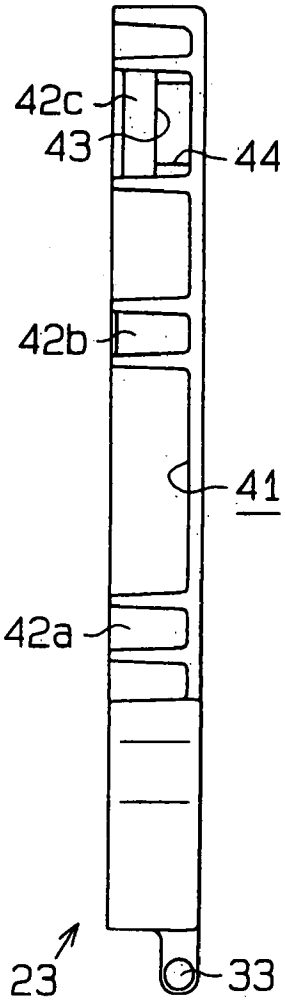
FIG. 7(*a*) is a front view showing part of a short side wall.
Figure 7A:
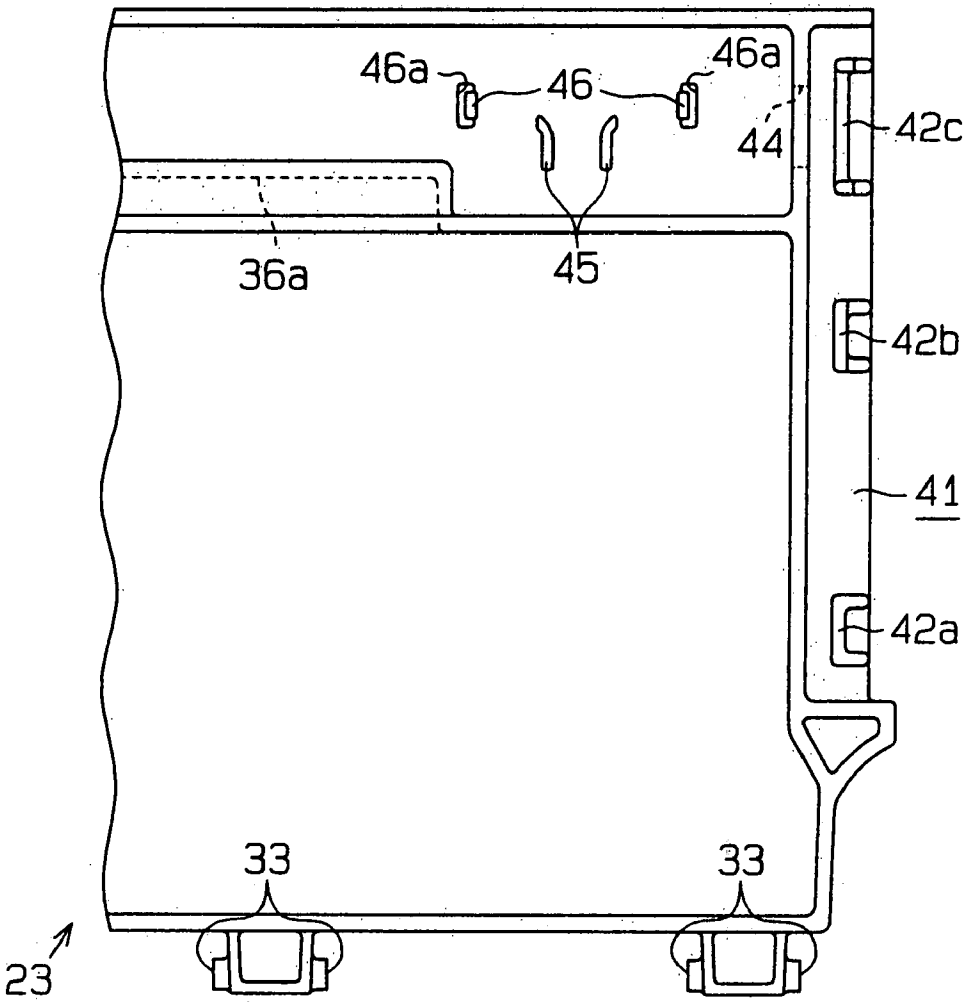

As shown in FIG. 7(*a*) and FIG. 7(*b*), in both ends of the short side wall 23, substantially rectangular engagement recesses 41 are provided in the upper positions in the outer side. On the lower end, the center portion, and the upper end of this engagement recess 41, a lower portion limiting protrusion 42*a*, a center portion limiting protrusion 42*b*, and an upper portion limiting protrusion 42*c* constituting limiting means any of which is formed into a side face substantially U-shape are formed to protrude so as to extend outward of the short side wall 23. In the center of the proximal end of the upper portion limiting protrusion 42*c*, a first rectangular hole 43 is formed to extend laterally. Besides, at the position in the inner side direction position of the first long hole 43, a second long hole 44 is provided by forming a proximal end of a side wall rib formed to protrude along the periphery of the rectangular engagement recess 41.

Figure 9:
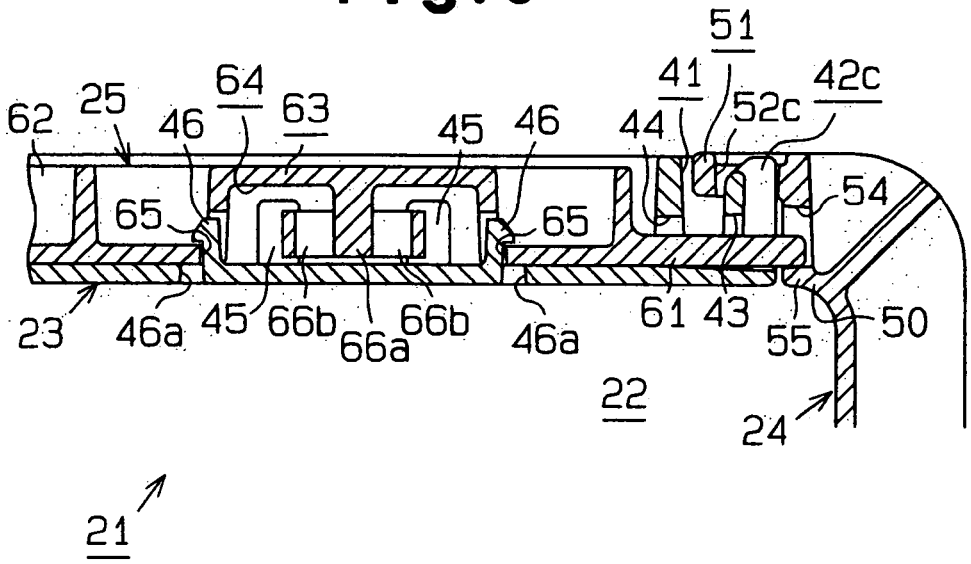
FIG. 9 is a plan sectional view showing the container body to which an engagement member is formed to be attached.

On the outside face of the short side wall 23 positioning inside the second long hole 44, a pair of left and right side wall protrusions 45 constituting biasing means are formed to protrude outward. Both side wall protrusions 45 expand toward the upper side in FIG. 7(*a*). As shown in FIG. 9, on the outside faces of the short side walls positioning in both side directions of each side wall protrusion 45, each pair of sliding engagement projections 46 formed into a plan cross section with a substantially L-shape are formed to protrude outward. Besides, in the proximal end of the sliding engagement projection 46, in the molds used when forming the short side wall 23, a long hole 46*a* constructed so as to be able to form the sliding engagement projection 46 by vertical drawing only by an upper mold and a lower mold is formed to penetrate.

Figure 6C:
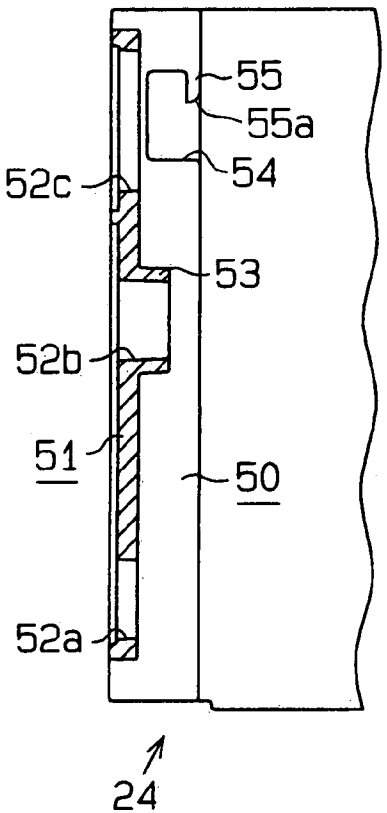
FIG. 6(*a*) is a side view of a long side wall.
Figure 6B:
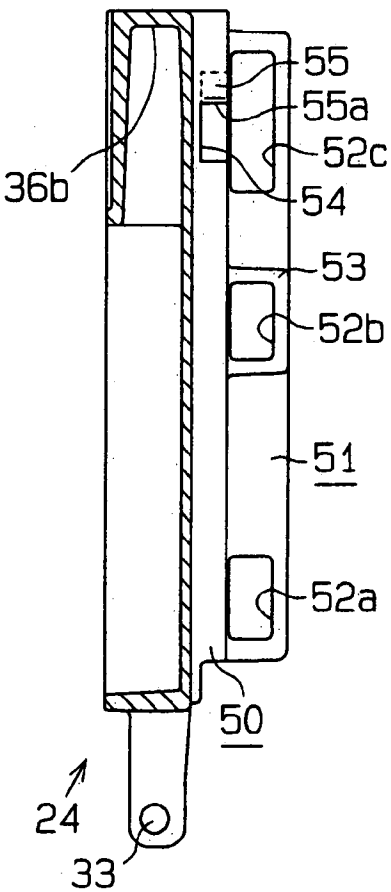
Figure 6A:
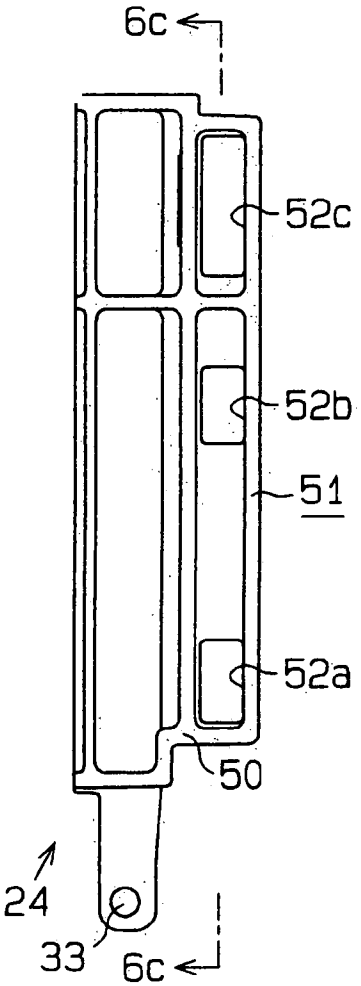

As shown in FIG. 6(*a*) to FIG. 6(*c*), fold-back portions 50 formed into rectangular plates are formed to protrude so as to extend in parallel with the short side wall 23 in both ends of the long side wall 24. On the distal end of this fold-back portion 50, a limiting board 51 formed into a rectangular plate is formed to protrude so as to extend in parallel with the short side wall 23, and when the container body 21 is assembled, it is constructed so as to be contained in the engagement recess 41 of the short side wall 23. This limiting board 51 is formed into a board shape which is thinner than the fold-back portion 50, and when the container body 21 is assembled, it is constructed so as to prevent the short side wall 23 from rotating outside the container body 21. Besides, the end face of the fold-back portion 50 on the side where the limiting board 51 is provided is constructed so as to be bonded to the outer edge of the engagement recess 41 of the short side wall 23 when the container body 21 is assembled.

In the lower end, the center portion, and the upper end of this limiting board 51, a lower portion limiting hole 52*a*, a center portion limiting hole 52*b*, and an upper portion limiting hole 52*c* constituting limiting means any of which is formed into a rectangular hole. Further, on the back face of the center portion limiting hole 52*b*, an engagement frame portion 53 constituting limiting means formed into a rectangular frame shape along the periphery of the center portion limiting hole 52*b* is formed to protrude so as to extend into the container body 21. When the container body 21 is assembled, these limiting holes 52*a*, 52*b*, and 52*c* are, constructed so that the limiting protrusions 42*a*, 42*b*, and 42*c* of the short side wall 23 are inserted to engage, and also constructed so as to stop the long side wall 24 to rotate outside the container body 21. Further, as shown in FIG. 5, when the container body 21 is folded, these limiting board 51 and engagement frame portion 53 are to be contained in the receiving recess 35 of the supporting protrusion 31*a*.

As shown in FIG. 6(*b*) and FIG. 6(*c*), the proximal end of the limiting board 51 is provided with engagement recesses 54 by forming to recess both ends on the inside faces of the long side wall 24 into a substantially rectangular shape. On the upper end of this engagement recess 54, an engagement portion 55 is formed to hang so as to extend along the inside face of the fold-back portion 50 and extend in parallel with the limiting board 51. A slanting face 55*a* formed so as to slant outside the container body 21 nearer to the distal end is provided at the distal end of the container body 21 on the inner side of this engagement portion 55.

Figure 1:
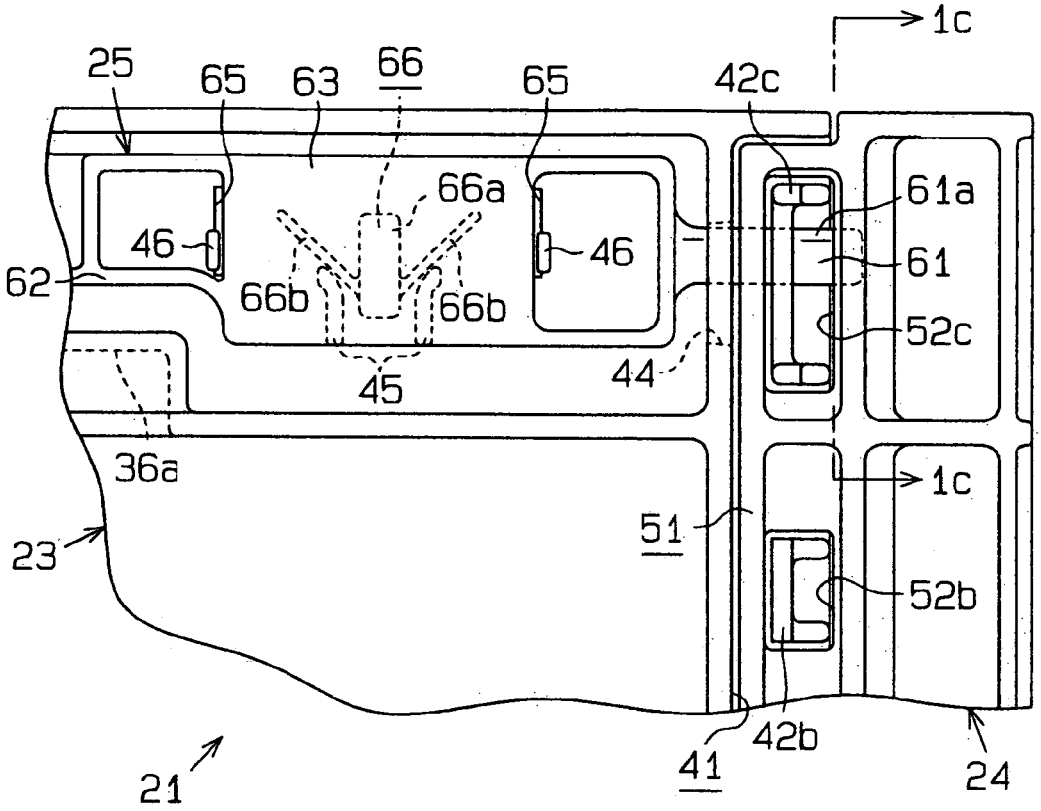
FIGS. 1(*a*) and (*b*) are partially enlarged side views showing part of the container body of a foldable transportation container of an embodiment of the present invention.
Figure 1:
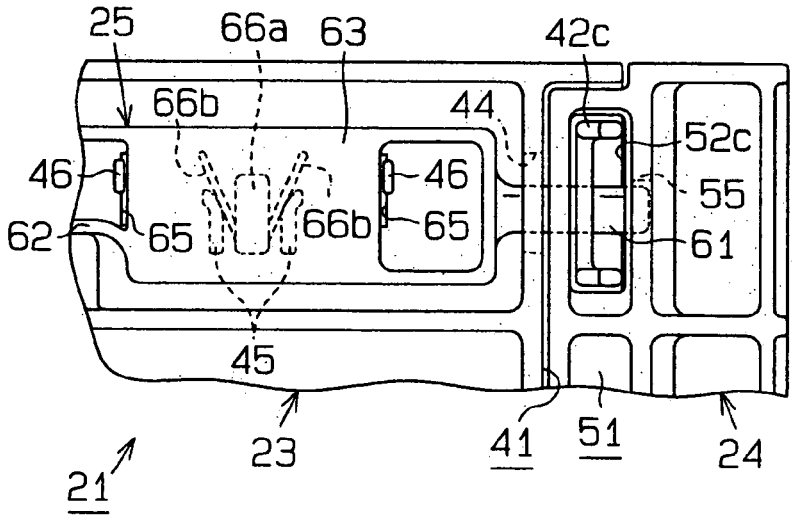
Figure 1:
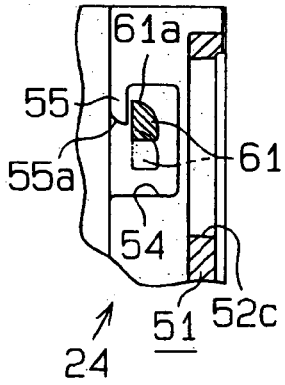
Figure 8A:
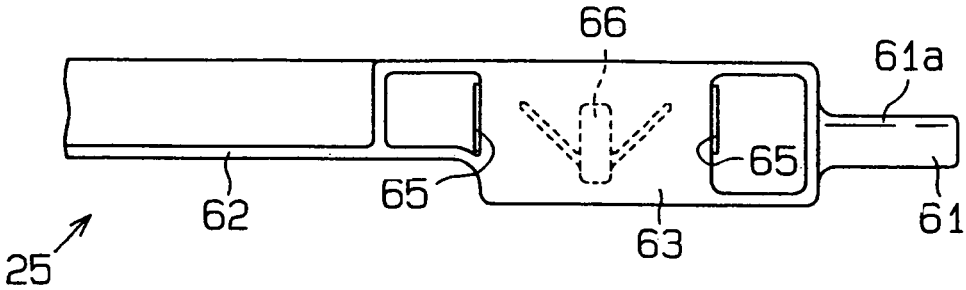
FIG. 8(*a*) is a front view showing part of an engagement member.
Figure 8B:
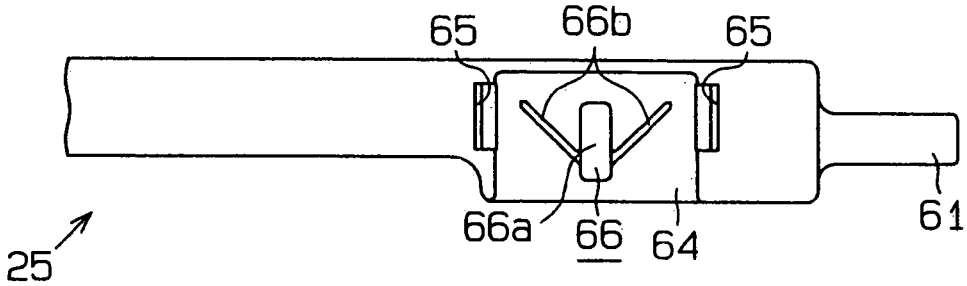

As shown in FIG. 1, FIG. 8(*a*), and FIG. 8(*b*), the engagement member 25 made of a synthetic resin into the substantially rectangular board is formed to be attached so as to be slidable with a predetermined width vertically along the outside face of the upper end of the short side wall 23. On both ends of this engagement member 25, engagement projections 61 formed into a pole having a rectangular cross-section are formed to protrude so as to extend outward. On the upper end of the outer sides of these engagement projections 61, a second slanting face 61*a* formed so as to slant inside the container body 21 nearer to the upper end is provided.

An operation rib 62 as an operation portion extending laterally is formed to protrude outward on the lower end center of the engagement member 25. On the middle portion between this operation rib 62 and the engagement projection 61, a protruding portion 63 is provided by protruding the wall face constituting the engagement member 25 toward an outer side direction into a rectangular box shape. The back face of this protruding portion 63 is a recessed portion 64 formed to be recessed into a rectangular shape. Note that this recessed portion 64 is opened on the back face side and the lower face side. Further, at the proximal portions on both side faces of the protruding portion 63, a pair of left and right sliding engagement holes 65 is formed to penetrate into a long hole shape extending vertically.

As shown in FIG. 8(*a*) to FIG. 9, on the center portion of the recessed portion 64, a biasing projection constituting biasing means formed into a side face having a shape of downward arrow is provided on the back face side of the engagement member 25. This biasing projection 66 is made up of a biasing protrusion 66*a* formed into a pole having a rectangular cross-section, and a pair of left and right biasing boards 66*b* formed to protrude so as to extend upward obliquely from the lower ends of both side faces of the biasing protrusion 66*a*. In addition to the fact that the proximal end of the biasing protrusion 66*a* is formed to protrude from the wall face of the recessed portion 64, on its distal end, both the biasing boards 66*b* are formed to protrude. In addition to that these biasing boards 66*b* are formed so as to extend obliquely upward at an angle of nearly 45° with respect to a longitudinal direction (a vertical direction), as shown in FIG. 1(*b*), it is constructed to be predetermined angle elastically deformable with respect to the biasing protrusion 66*a*.

The engagement member 25 constructed as described above is assembled at a predetermined position of the upper end of the outside face on the short side wall 23 to be used. In case of assembling this engagement member 25, first, as shown in FIG. 1(*a*), after one engagement projection 61 is inserted in the second long hole 44 and the first long hole 43 formed in one end of the short side wall 23, the other engagement projection 61 is inserted in the second long hole 44 and the first long hole 43 formed in the other end of the short side wall 23. Next, the engagement member 25 is pressed toward the outside face of the short side wall 23 in a state that each sliding engagement hole 65 of the engagement member 25 is made to correspond to the sliding engagement projection 46 of the short side wall 23. As a result, each sliding engagement projection 46 is forcedly fitted on the peripheral portion of the sliding engagement hole 65, and the engagement member 25 is attached to the outside face of the short side wall 23.

Figure 3:
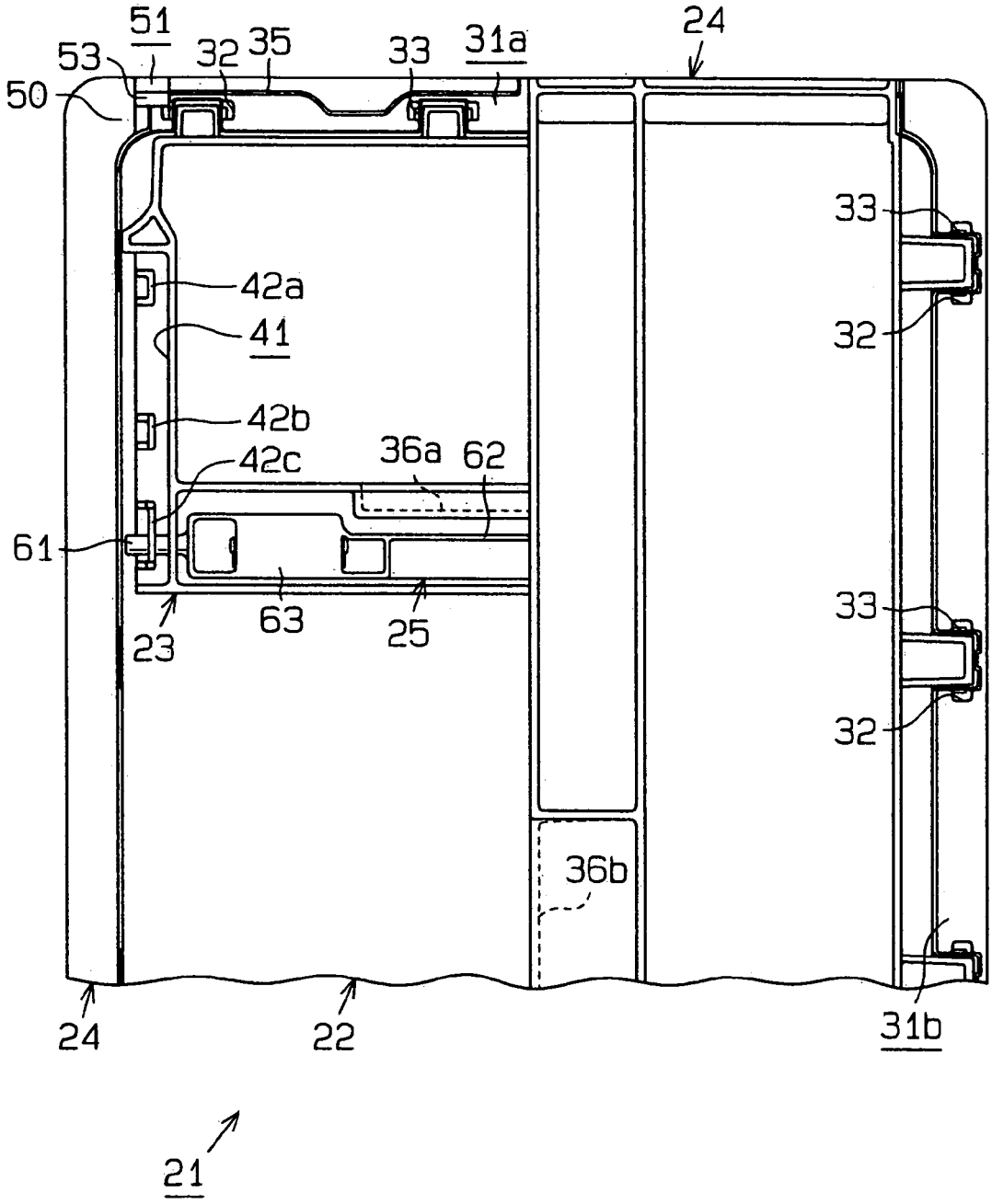
FIG. 3 is a plan view showing the container body in which a side wall is folded.

At this time, the engagement member can be slid vertically with a predetermined width in a state that each pair of sliding engagement projections 46 formed on the outside face of the short side wall 23 is engaged with the peripheral portions of the sliding engagement holes 65. Further, by bringing each pair of biasing boards 66*b* in contact with the upper end of the side wall protrusion 45 of the short side wall 23, it is always biased upward. Besides, in case of pressing downward the engagement member 25 to be slid, as shown in FIG. 1(*b*), both the biasing boards 66*b* are constructed so as to be elastically deformed with sliding on the upper end of the side wall protrusion 45. Further, as shown in FIG. 3, the distal end of the engagement projection 61 is disposed at the middle position between the inside face of the long side wall 24 and the outer edge of the engagement recess 41, and in addition to the fact that it is constructed so as not to come into contact with the inside face of the supporting protrusion 31*b* in the container body 21 in a folded state, it is constructed so as not to come into contact with the inside face of the long side wall 24 in the course of assembling.

Figure 4:
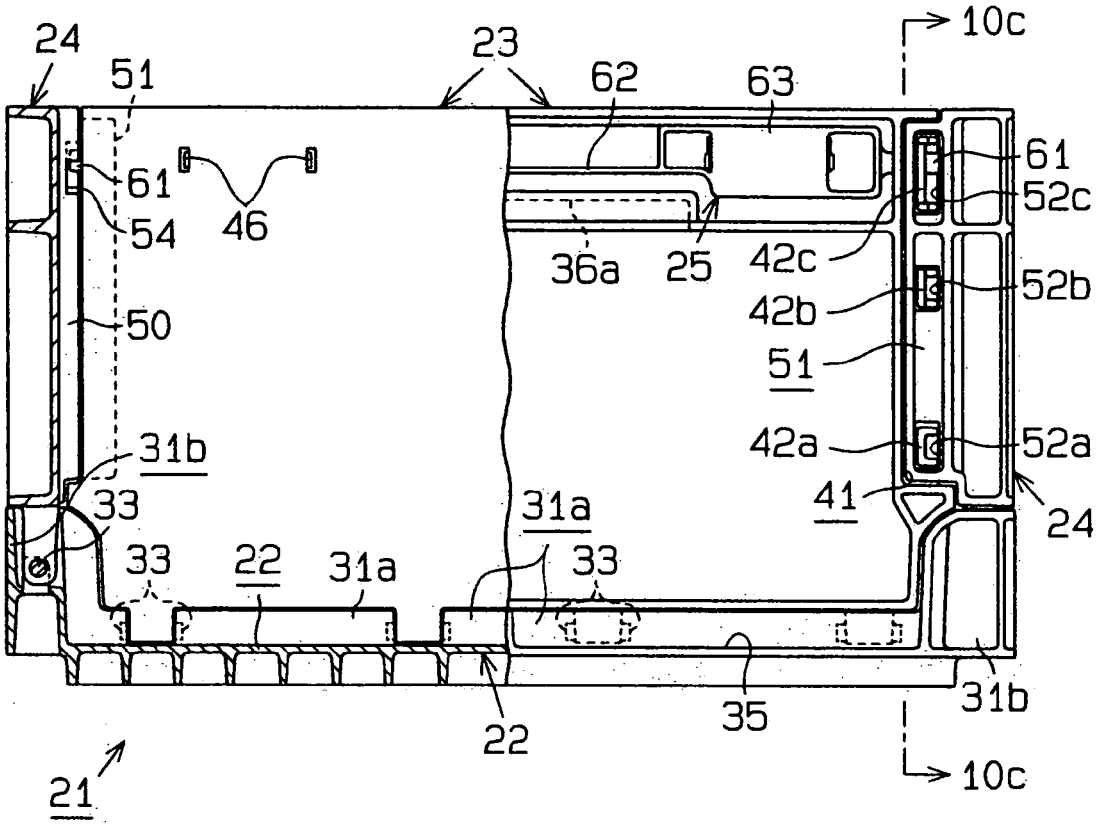
FIG. 4 is a side view showing the container body a part of which is cut away.

On the other hand, as shown in FIG. 4, in the container body 21 in an assembled state, in addition to the fact that the inside face of the limiting board 51 of the long side wall 24 is disposed to be adjacent to or in contact with the outside faces of the engagement recesses 41 of both ends of the short side wall 23, each limiting protrusion 42*a*, 42*b*, or 42*c* of the engagement recess 41 is in a state of being inserted to engage in the limiting hole 52*a*, 52*b*, or 52*c* at the lower portion. Further, as shown in FIG. 1(*a*), the engagement projections 61 of both ends of the engagement member 25 are in a state of being inserted in the second long hole 44 and the first long hole 43 of the short side wall 23 in the order from the proximal end side. In addition, as shown in FIG. 1(*c*), the distal end of the engagement projection 61 is inserted in the engagement recess 54 of the long side wall 24, and further it is in a state of being engaged with the engagement portion 55.

The operation of the above foldable transportation container will be described below.

By the way, when the foldable transportation container constructed as described above is folded, first, the operation rib 62 of the engagement member 25 formed on the upper end of the short side wall 23 is pressed downward, and in a state that the engagement member 25 is slid downward on the outside face of the short side wall 23, the short side wall 23 is rotated inside the container body 21. At this time, as shown in FIG. 1(*b*), as the engagement member 25 is slid downward against the biasing force of the biasing board 66*b*, the engagement projection 61 is moved down, and as shown by an alternate long and two short dashes line in FIG. 1(*c*), an engagement state between the engagement projection 61 and the engagement portion 55 of the long side wall 24 is released, and the short side wall 23 is in a state of being rotatable inside the container body 21. Incidentally, the engagement member 25 is not made to be moved down more than a predetermined width in such a manner that the lower end face of the operation rib 62 is brought into contact with the upper end of the outside face of the handle hole 36*a*.

Subsequently, by folding the long side wall 24 onto the upper faces of both the short side walls 23 folded, as shown in FIG. 3 and FIG. 5, the container body 21 is compactly folded into a small flat board shape. At this time, as shown in FIG. 5, the limiting boards 51 formed to protrude on both ends of the long side wall 24 are received in the receiving recess 35 of the supporting protrusion 31*a*, and the upper end face of the long side wall 24 in a folded state is disposed at a low position. Further, the container body 21 of this foldable transportation container can be vertically piled in a folded state.

Figure 10A:
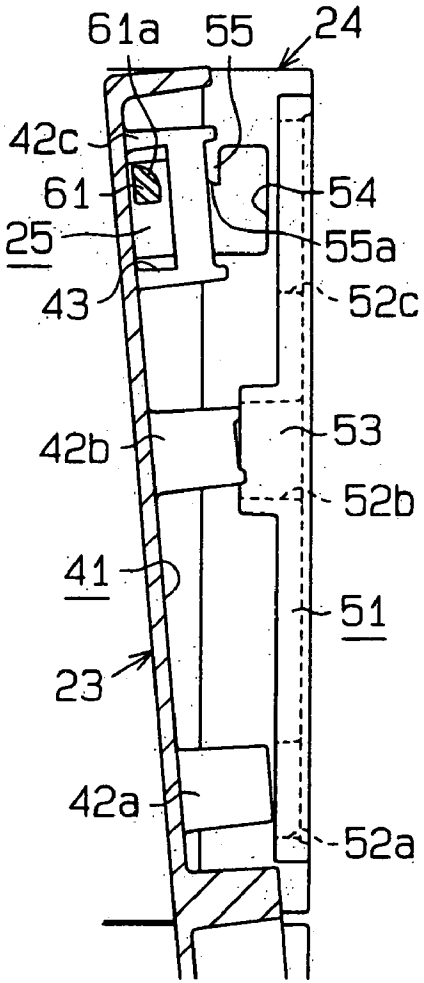
FIGS. 10(*a*) to 10(*c*) are front sectional views showing an operation when the container body of the embodiment is assembled or folded.
Figure 10B:
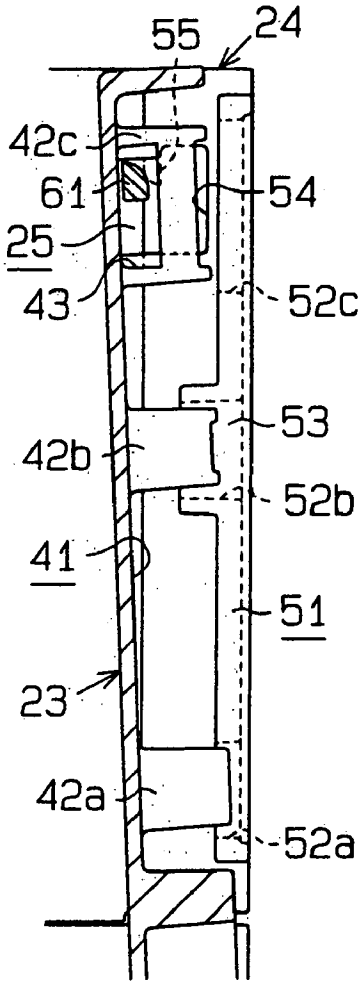
Figure 10C:
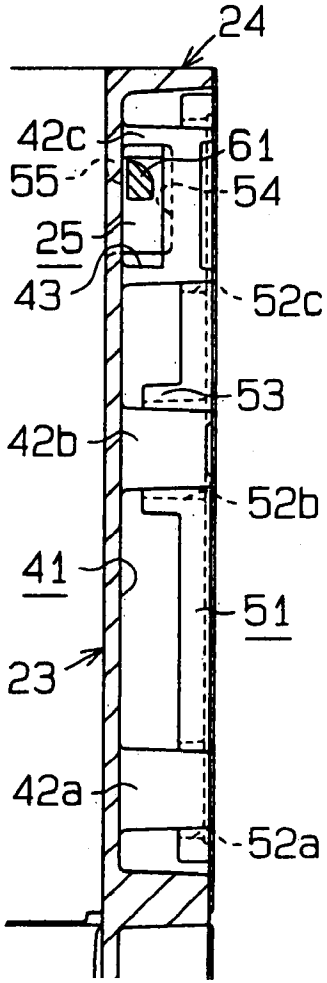

On the other hand, when the foldable transportation container in the folded state is assembled, after a pair of long side walls 24 is rotated 90° on the rotational axis 33 to stand on the upper end face of the supporting protrusion 31*b*, a pair of short side walls 23 is similarly rotated to stand on the upper end face of the supporting protrusion 31*a*. When the short side wall 23 is rotated, first, as shown in FIG. 10(*a*), the distal ends of limiting protrusions 42*b* at both center portions formed to stand on both ends of the short side wall 23 are engaged with the distal ends of the engagement frame portions 53 formed on the limiting boards 51 of two adjacent long side walls 24. As a result, the left and right long side walls 24 adjacent to the short side wall 23 are in a state of standing in a stable state on the supporting protrusions 31*b*, the rotational direction of the short side wall 23 is determined, and the relative positional relation between the short side wall 23 and both long side walls 24 is fixed.

Subsequently, as shown in FIG. 10(*b*) and FIG. 10(*c*), the limiting protrusion 42*b* at the center portion is inserted to engage in the engagement frame portion 53, and the distal ends of the limiting protrusions 42*a* at the lower portion of the short side wall 23 are engaged with the limiting holes 52*a* at the lower portion formed in the limiting boards 51 of two adjacent long side walls 24. Further, the distal ends of the upper portion limiting protrusions 42*c* of the short side wall 23 are engaged with the upper portion limiting holes 52*c* of the limiting boards 51 of two adjacent long side walls 24, and the positional relation between the short side wall 23 and both long side walls 24 is fixed still more strongly. That is, the rotations outward and inner side directions of both long side walls 24 in accordance with the rotation of the short side wall 23 is in a state of being securely restricted.

In addition, at this time, the engagement projection 61 of the engagement member 25 is moved up in accordance with the biasing force of the biasing means at the same time with the completion of the contact state with the engagement portion 55, after its second slanting face 61*a* is brought into contact with the engagement portion 55 of the long side wall 24 and after once being moved down against the biasing means while sliding on the slanting face 55*a*. As a result, as shown in FIG. 10(*c*), the distal end of the engagement projection 61 is inserted in the engagement recess 54 and in a state of being engaged with the engagement portion 55, and the short side wall 23 is prevented from rotating inside the container body 21. Further, since the limiting board 51 of the long side wall 24 is formed to protrude so as to cover the outside face of the short side wall 23, the outward rotation of the short side wall 23 is also limited. Therefore, the short side wall 23 in this assembled state is limited to rotate in either direction of inward or outward directions of the container body 21, and fixed to vertically stand on the upper end face of the supporting protrusion 31*a*.

Further, since a pair of left and right long side walls 24 is disposed in a state of being in contact with the outside faces on both ends of the short side wall 23, the walls are prevented from rotating inside the container body 21. Further, as shown in FIG. 4, since the limiting protrusions 42*a*, 42*b*, and 42*c* formed on both ends of the short side wall 23 are inserted to engage in the limiting holes 52*a*, 52*b*, and 52*c*, respectively, formed in the limiting board 51 of the long side wall 24, the rotation of the long side wall 24 inside the container body 21 is also limited. Therefore, a pair of long side walls 24 in this assembled state is limited to rotate in either direction of inward and outward directions of the container body 21, and fixed to vertically stand on the upper end face of the supporting protrusion 31*b*.

This foldable transportation container is conveyed by holding the handle hole 36*a* or 36*b* formed in the center portion of a pair of short side walls 23 or long side wall 24, with both hands. In addition, this foldable transportation container can be vertically piled in an assembled state, and the container body 21 in the above folded state can also be piled on or under the container body 21 in the assembled state.

Effects obtained by the above embodiment will be described below.

The foldable transportation container of the above embodiment comprises the bottom wall 22 formed into a rectangular board, a pair of short side walls 23 formed to stand along one opposing sides of the bottom wall 22, and a pair of long side walls 24 formed to stand along the opposing sides of the bottom wall 22. Further, on the lower end of each of the side walls 23 and 24, the bearing portion 32 and the rotational axis 33 for folding each side wall 23 or 24 inside the container body 21 are provided, and after the short side walls 23 are folded onto the upper face of the bottom wall 22, by folding the long side walls 24 onto the upper face of the short side walls 23, the container body 21 is constructed to be foldable.

In addition, on the outside face of the short side wall 23, the operation rib 62 is provided on the center portion and the engagement member 25 on both ends of which the engagement projections 61 are formed to stand is formed. Moreover, on both ends of the long side wall 24, the limiting boards 51 for limiting the outward rotations of the short side walls 23 are formed to stand, and further the engagement portions 55 for engaging with the engagement projections 61 to limit the inward rotations of the short side walls 23 are provided. Further, the limiting holes 52*a*, 52*b*, and 52*c* and the limiting protrusions 42*a*, 42*b*, and 42*c* for limiting the outward rotations of the long side walls 24 are provided in the bonding portions between the limiting boards 51 and both ends of the short side walls 23. And, by moving down the operation rib 62 of the engagement member 25, it is constructed so as to release an engagement state between the engagement projection 61 and the engagement portion 55.

Therefore, an engagement state between the engagement projection 61 and the engagement portion 55 can be released by one touch by pressing downward the operation rib 62 of the engagement member 25. Thus, the container body 21 in an assembled state can be folded very easily. In particular, since one short side wall 23 can be folded onto the upper face of the bottom wall 22 by one touch with one hand, in comparison with the conventional foldable container having a construction in which one short side wall is folded with both hands, the folding operation can be performed still more easily. Further, even when the container body 21 is assembled, since the operation for fixing to stand one short side wall 23 on the supporting protrusion 31*a* can be performed by one touch with only one hand, the assembling operation can also be performed very easily.

Further, since the operation rib 62 of the engagement member 25 is formed at a position close to the handle hole 36*a*, even in a state that both handle holes 36*a* of the container body 21 in an assembled state are held with both hands, the operation rib 62 is operated to be pressed downward using the thumb that can freely be moved in that state. Further, since the operation rib 62 is constructed so as to be pressed downward, it is possible to very effectively apply the pressing force by the thumb to the operation rib 62 in that state. It should be noted that in this folding method, even in case of operating to press upward the operation rib 62 with the thumb, although it is almost similarly effective, for example, in case of operating to press laterally, the pressing force can not so effectively be applied.

On the bonding portion between the short side wall 23 and the engagement member 25, in order to maintain an engagement state between the engagement projection 61 and the engagement portion 55, the assembling operation of the container body 21 can be performed very easily by providing the side wall protrusion 45 and the biasing projection 66 biasing the engagement projection 61 in a predetermined direction. That is, by this construction, after a pair of long side walls 24 is rotated around the rotational axis 33 to stand, it is possible to automatically engage the engagement projection 61 and the engagement portion 55 by similarly rotating a pair of short side walls 23 to stand. Further, by virtue of the side wall protrusion 45 and the biasing projection 66, it is also possible to easily maintain an assembled state of the container body 21, and ease to use when the container body 21 is used can sufficiently be obtained.

By moving down the operation rib 62, and constructing so as to release an engagement state between the engagement projection 61 and the engagement portion 55, an erroneous operation when the container body 21 in an assembled state is conveyed is easily prevented, and the workability upon conveyance can easily be enhanced. That is, when the container body 21 in an assembled state is conveyed, a finger is inserted from the lower side to the upper side of the handle hole 36*a* to lift up the container body 21. At this time, although the possibility that the finger is erroneously caught by the lower end face of the operation rib 62 is very high, in the container body 21 of this embodiment, even in the case where the finger is caught by the lower end face of the operation rib 62, the shape of the container body 21 is constructed to be maintained in a state as it is.

In the contact portion where the engagement projection 61 and the engagement portion are in contact with each other, when the container body 21 is assembled, the engagement projection 61 can be engaged easily and smoothly with the engagement portion 55 by providing the second slanting face 61*a* on the outside of the engagement projection 61 (on the outside face side of the container body 21). Therefore, the assembling operation of the container body 21 can be performed easily and rapidly. Further, in the contact portion, the assembling operation of the container body 21 can be performed further easily and rapidly by providing the slanting face 55*a* on the inside of the engagement portion 55 (on the inside face side of the container body 21).

Note that this embodiment can also be implemented by a modification as follows.

Figure 11:
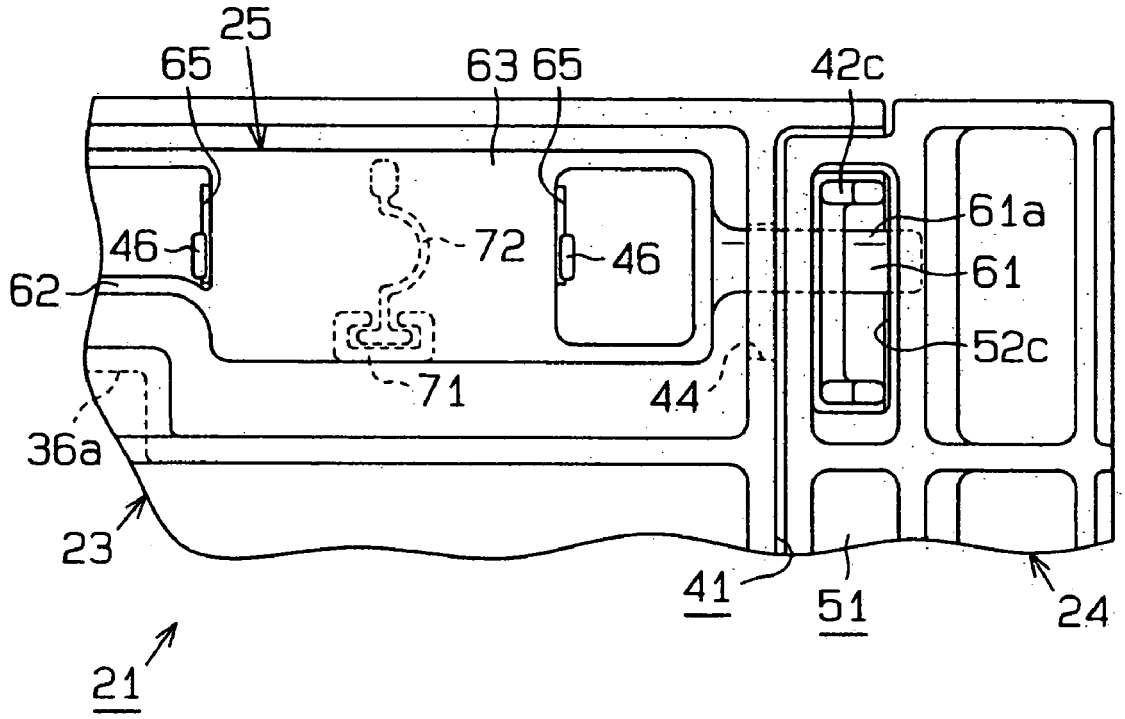
FIGS. 11(*a*) and 11(*b*) are partially enlarged side views showing part of the container body of a foldable transportation container according to another embodiment.
Figure 11:
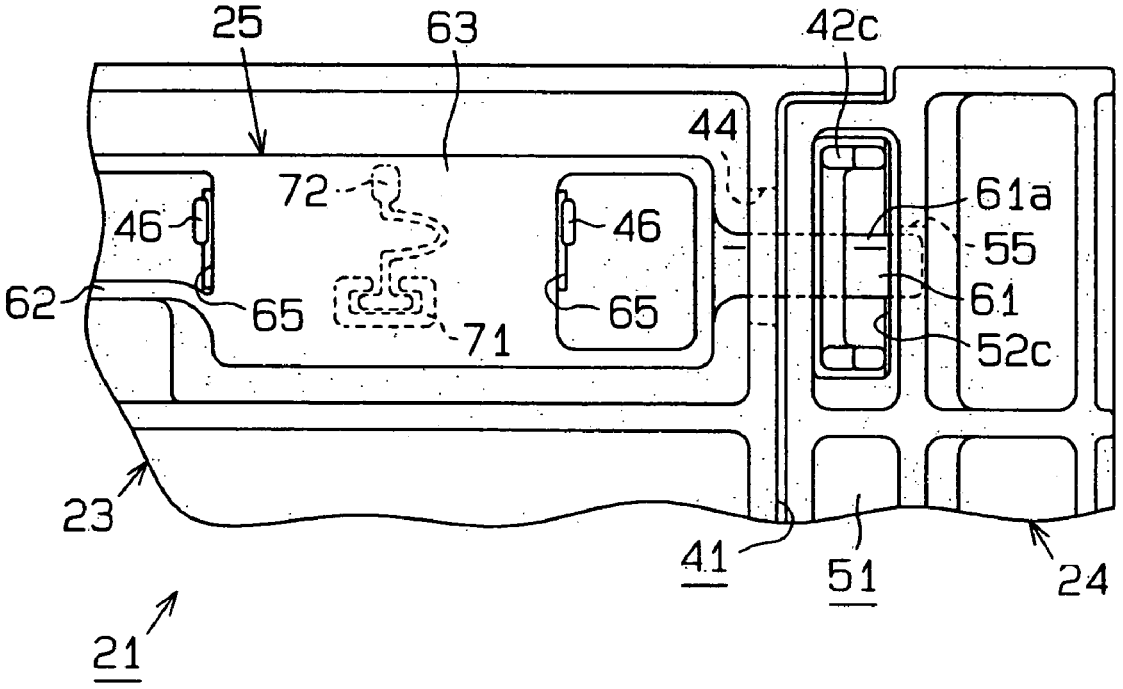

As shown in FIG. 11(*a*) and FIG. 11(*b*), a side wall protrusion 71 formed into a side face with a lateral C-shape is formed to protrude on the outside face of the short side wall 23, and a spring member 72 is disposed in the recessed portion 64 of the engagement member 25. Note that the upper end of the spring member 72 is in contact with the lower face on the upper wall of the recessed portion 64, and the lower end thereof is engaged with the side wall protrusion 71. Further, the center portion of this spring member 72 is constructed so as to be elastically deformable as shown in FIG. 11(*b*), and always biases upward the engagement member 25 (the operation rib 62). And, biasing means is constituted by these side wall protrusion 71 and spring member 72.

Figure 12A:
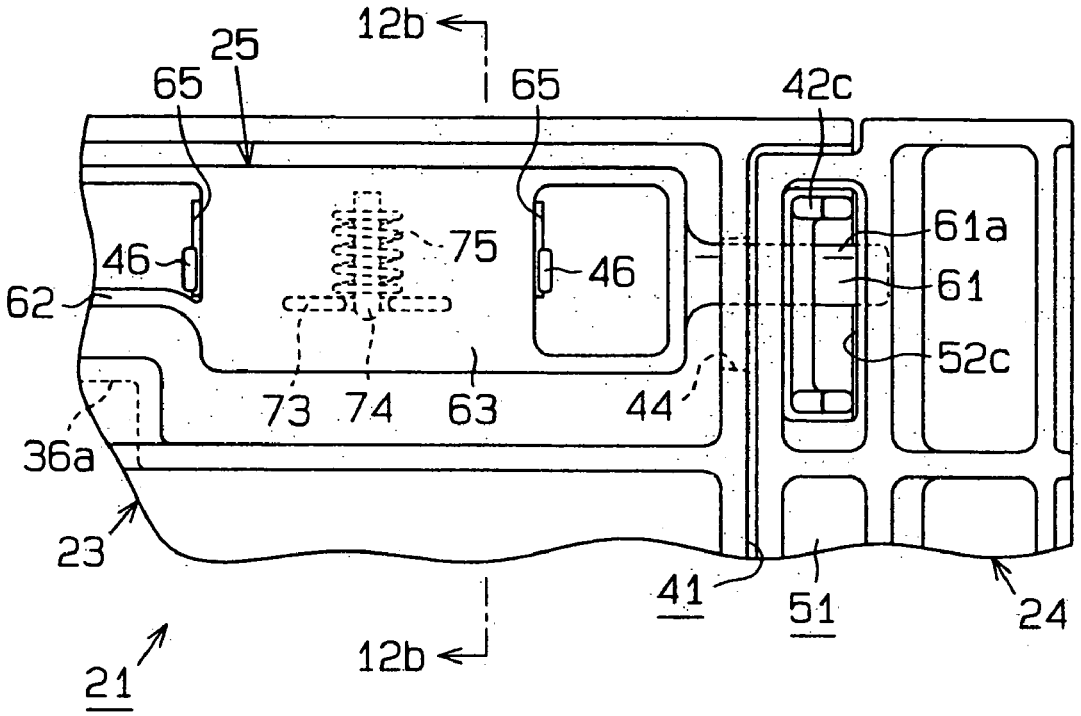
FIG. 12(*a*) is a partially enlarged side view showing part of the container body of the foldable transportation container according to another embodiment.
Figure 12B:
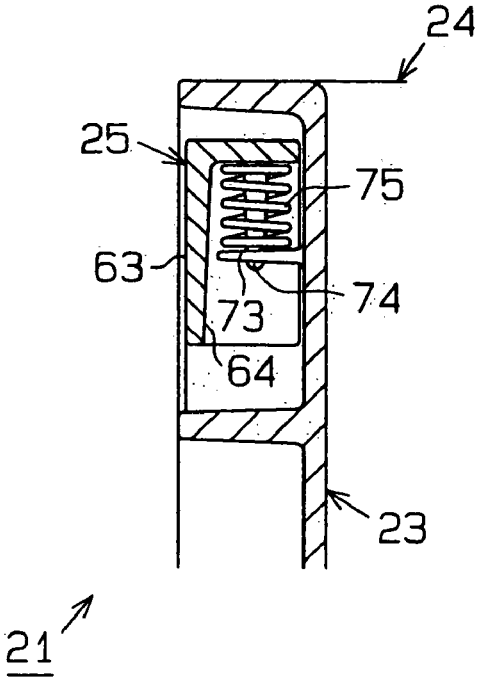

As shown in FIG. 12(*a*) and FIG. 12(*b*), in place of forming the side wall protrusion 45 to protrude on the outside face of the short side wall 23, a side wall protrusion 73 in the center portion of which a circular hole or a long hole is formed to penetrate is formed to protrude, a fixed bar 74 is hung down from the lower face of the upper wall of the recessed portion 64, and the distal end of the fixed bar 74 is constructed so as to be inserted in the hole of the side wall protrusion 73. Further, a coil spring 75 is disposed around the fixed bar 74, and by constructing so that the upper end of the coil spring 75 is in contact with the upper wall lower face of the recessed portion 64, and the lower end is in contact with the upper face of the side wall protrusion 73, the engagement member 25 (the operation rib 62) is constructed so as to be always biased upward. And, biasing means is constituted by these side wall protrusion 73, fixed bar 74, and coil spring 75.

Figure 13A:
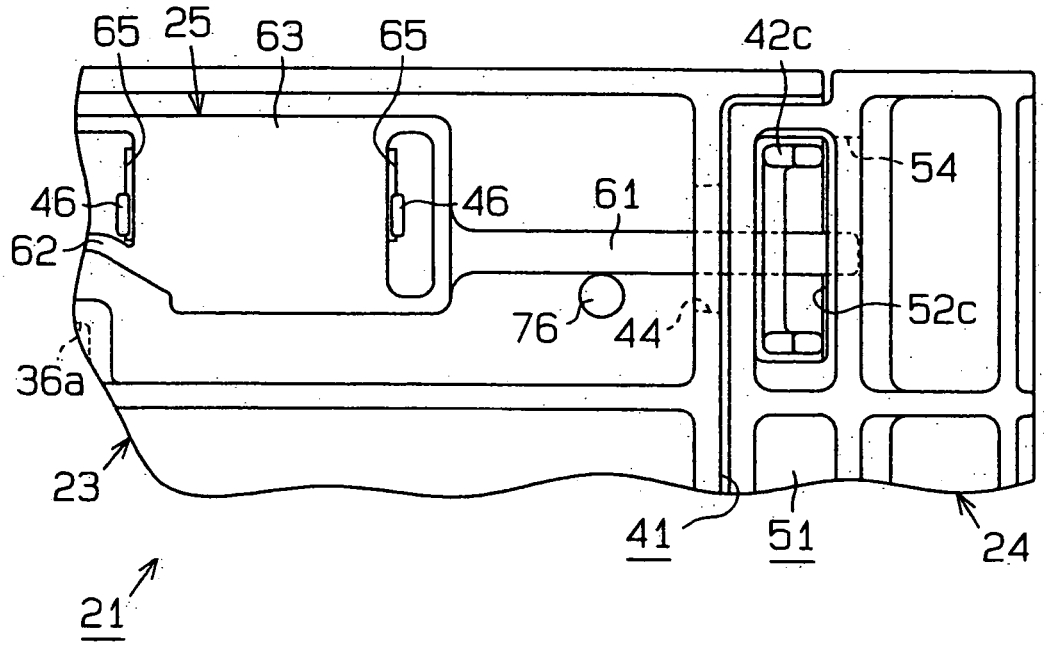
FIGS. 13(*a*) and 13(*b*) are partially enlarged side views showing part of the container body of a foldable transportation container according to another embodiment.
Figure 13B:
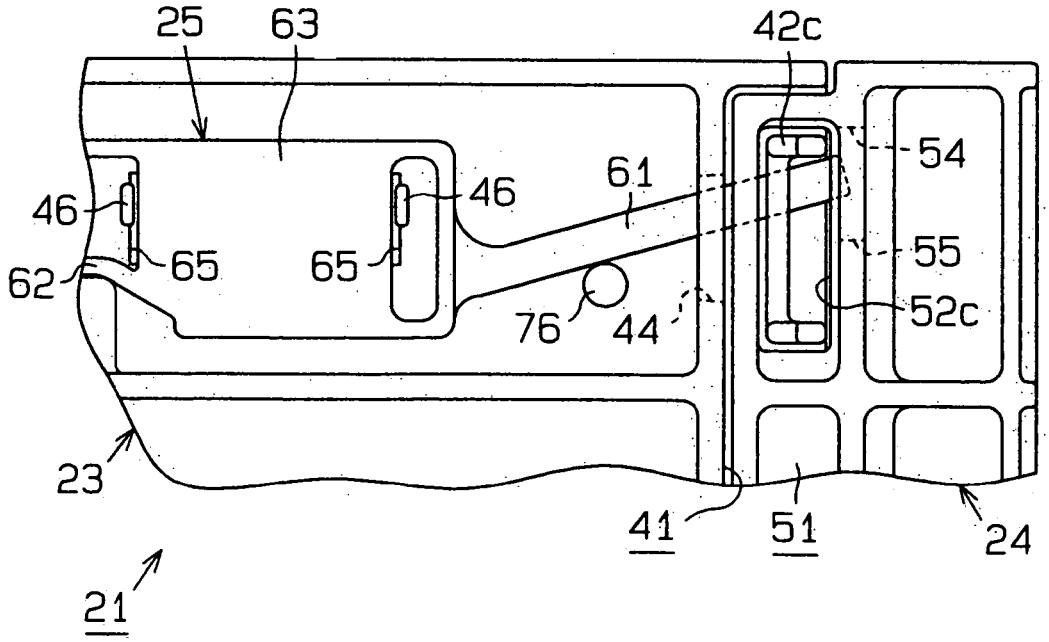

As shown in FIG. 13(*a*) and FIG. 13(*b*), a side wall protrusion 76 formed into a lateral cylindrical shape (side face with a circular shape) is formed to protrude on the outside face of the short side wall 23, and also the engagement projection 61 of the engagement member 25 is disposed so as to be in contact with the side wall protrusion 76. Further, the center portion of the engagement member 25 (the operation rib 62) is constructed so as to be always biased upward by making the engagement member 25 of a synthetic resin which can be elastically deformed with ease. In addition, the engagement recess 54 is provided at substantially the same height as the upper end of the upper portion limiting hole 52*c*, and the engagement portion 55 is formed to protrude so as to extend upward from the lower end of the engagement recess 54. And, biasing means is constituted by these engagement projection 61 and side wall protrusion 76.

Figure 14A:
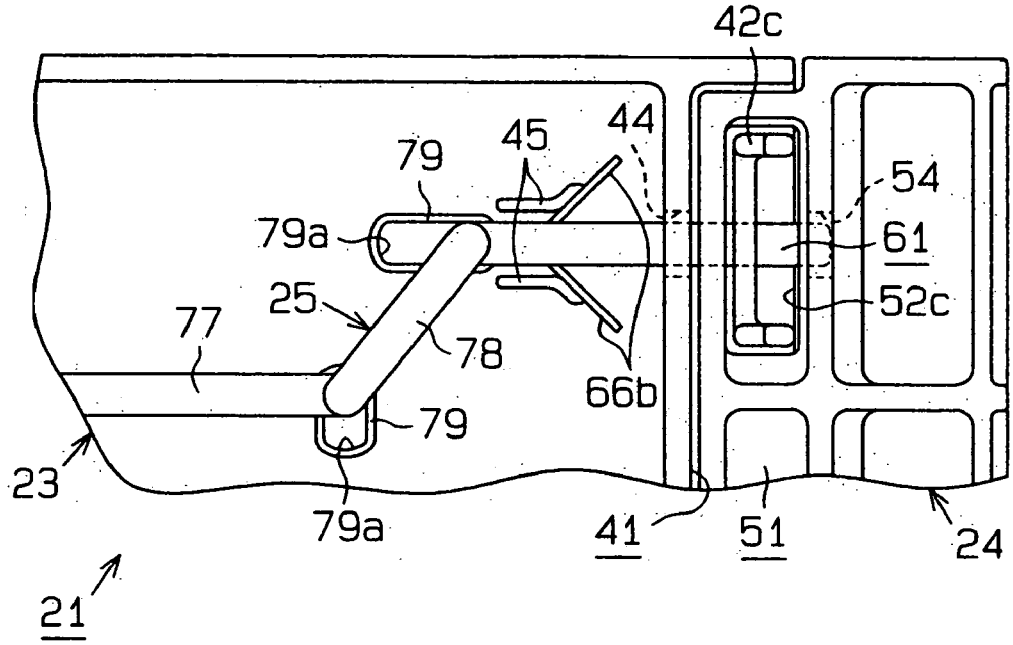
FIGS. 14(*a*) and 14(*b*) are partially enlarged side views showing part of the container body of a foldable transportation container according to another embodiment.
Figure 14B:
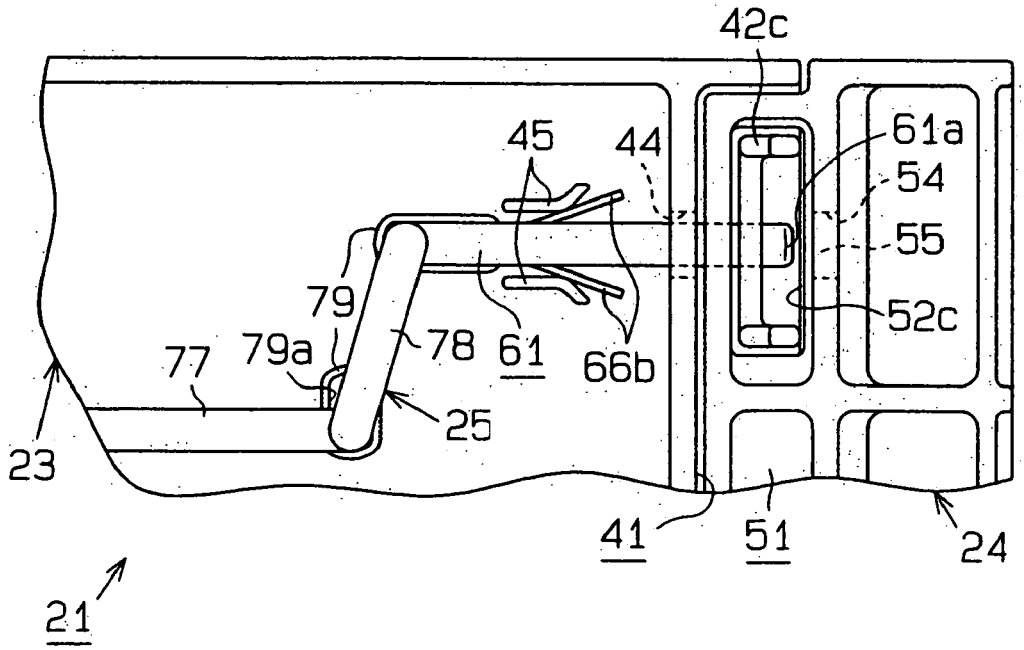

As shown in FIG. 14(*a*) and FIG. 14(*b*), the engagement member 25 is constituted by five members molded into separate bodies. That is, this engagement member 25 comprises an operation bar 77 as an operation portion and vertical sliding means extending laterally, and a pair of left and right connection bars 78 constituting sliding conversion means formed on both ends of the operation bar 77 and extending obliquely (for example, at 45° with respect to the operation bar 77). Further, on the outer ends of both the connection bars 78, a pair of left and right engagement projections 61 as horizontal sliding members extending horizontally are provided. In addition, both ends of the connection bar 78 are axially attached to one end of the operation bar 77 and the proximal end of the engagement projection 61 so as to be rotatable in a vertical plane in parallel with the outside faces of the respective short side walls 23.

Further, on back faces of both ends of the operation bar 77 and the back face of the proximal end (inner end) of the engagement projection 61, a sliding fitting protrusion (not shown) constituting sliding conversion means formed into a side face circular shape is formed to protrude, and forcibly fitted in a sliding fitting projection 79 of a rectangular frame shape constituting sliding conversion means formed at a corresponding position on the outside face of the short side wall 23. The sliding fitting protrusions formed on both ends of the operation bar 77 are constructed so as to be slidable vertically with a predetermined width in the sliding fitting projection 79, and the sliding fitting protrusion formed on the proximal end of the engagement projection 61 is slidable laterally with a predetermined width in the sliding fitting projection 79. Incidentally, the sliding fitting projection 79 is constructed so as to be molded by vertical drawing only with an upper mold and a lower mold by a long hole 79*a* to penetrate in the short side wall 23, in molds when the short side wall 23 is molded.

On the other hand, on the upper and lower faces at the center portion of the engagement projection 61, a pair of upper and lower biasing boards 66*b* extending obliquely upward and obliquely downward, respectively, are formed to protrude. On the outside faces of the short side walls 23 at positions corresponding to these biasing boards 66*b*, the side wall protrusions 45 are formed to protrude. The side wall protrusion 45 always biases the engagement projection 61 outward of the short side wall 23. Both side wall protrusions 45 expand from the left side toward the right side of FIG. 14(*a*). Further, the size of the second long hole 44 is formed into a size substantially corresponding to the engagement projection 61.

Further, by forming the distal end of the engagement portion 55 in the above embodiment to extend to the lower end of the engagement recess 54, the rectangular engagement recess 54 as an engagement portion is formed in a side face. As a result, in the state of FIG. 14(*a*), the distal end of the engagement projection 61 inserted in the engagement recess 54 is disposed so as to be able to be in contact with one side face (inside face) of the engagement portion 55, and the short side wall 23 is prevented from rotating inside the container body 21.

In addition, outer side at the distal end of the engagement projection 61 is preferably constructed so that the second slanting face 61*a* formed so as to slant inside the container body 21 nearer to the distal end may be formed. Moreover, along the edge of the back face of the engagement portion 55 (the side face on the container body 21 inner side), the slanting face 55*a* is preferably constructed so that it is formed to slant outward the container body 21 nearer to the end.

In such a construction, by pressing downward the operation bar 77, as shown in FIG. 14(*b*), both engagement projections 61 are laterally slid toward the inner side direction of the short side wall 23 through both connection bars 78, and the distal ends of the engagement projections 61 get out from the interior of the engagement recess 54. As a result, an engagement state between the engagement projections 61 and the engagement portion 55 is released, and the short side wall 23 is folded inside the container body 21. Therefore, by the above construction, the folding operation of the container body 21 can be performed very easily.

The slanting face 55*a* or the second slanting face 61*a* should not be formed on the engagement portion 55 or the distal end of the engagement projection 61. Or, the slanting face 55*a* and the second slanting face 61*a* are not formed on the engagement portion 55 and the distal end of the engagement projection 61.

The center portion of the engagement member 25 (the operation rib 62) is constructed so as to be always biased downward by biasing means. Further, by moving up the operation rib 62, it is constructed so as to release an engagement state between the engagement projection 61 and the engagement portion 55.

The biasing means is omitted, and on the bonding portion between the engagement member 25 and the short side wall 23, stopping means for stopping the engagement member 25 at a predetermined position is provided. Further, by moving up or moving down the operation rib 62, the container should be constructed such that an engagement state by the stopping means may be relatively easily released, and is also constructed such that an engagement state between the engagement projection 61 and the engagement portion 55 can be released.

In the case where such construction is made, when the container body 21 is assembled, the operation rib 62 is operated with pressure (lower movement or upper movement) immediately after the short side wall 23 is stood on the supporting protrusion 31*a* to engage the engagement projection 61 and the engagement portion 55, thereby the container body 21 can easily be assembled. In addition, an operation for folding the container body 21 can be performed very easily as in the above embodiment.

In place of forming the engagement member 25 along the outside face of the short side wall 23, it is to be formed along the outside face of the long side wall 24.

The engagement member 25 is constituted by a plurality of parts, and when it is attached to the container body 21, it may be constructed so as to connect the parts integrally. Note that, as the plurality of parts, for example, the parts may be those wherein the engagement member 25 of the above embodiment is equally divided into two or three in a longitudinal direction (a lateral direction), or among parts where the engagement member 25 of the above embodiment is equally divided into three in a longitudinal direction (a lateral direction), two parts positioning right and left (constituting both ends) and a metallic pipe connecting those parts may be used to construct the engagement member 25. In case of constructing the member in this manner, the length of the engagement projection 61 can be made long.

Figure 15A:
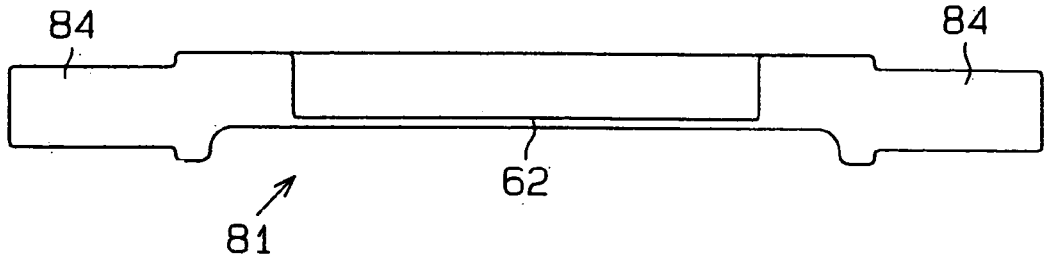
FIG. 15(*a*) is a front view showing an operation member constituting an engagement member in another embodiment.
Figure 15B:
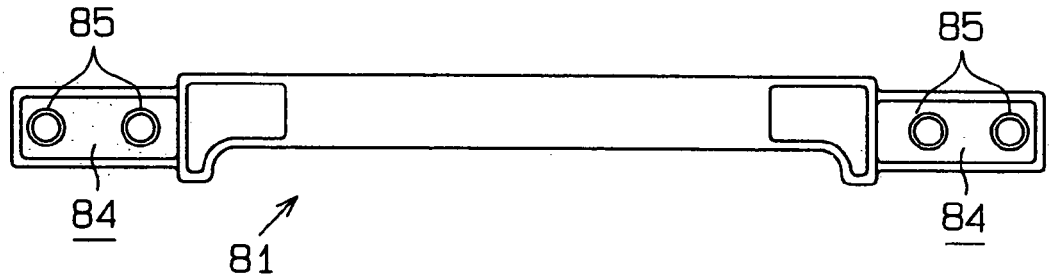
Figure 16A:
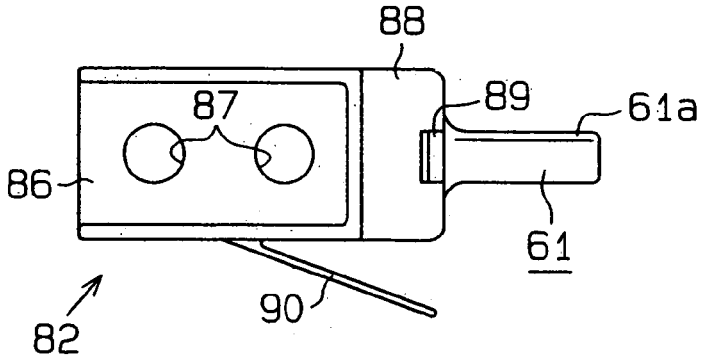
FIG. 16(*a*) is a front view showing one connecting member constituting an engagement member in another embodiment.
Figure 16B:
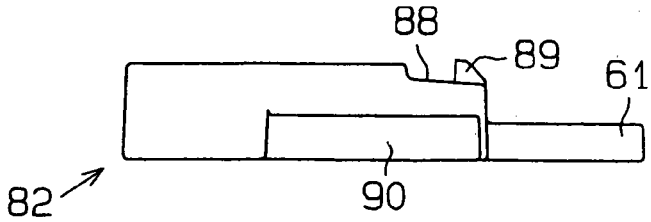

Using three parts of an operation member 81 shown in FIG. 15(*a*) and FIG. 15(*b*), one connection member 82 shown in FIG. 16(*a*) and FIG. 16(*b*), and the other connection member (not shown), an engagement member 83 is constructed. Note that after injection-molding the operation member 81 and a pair of connection members 82, the engagement member 83 is constructed integrally with them.

As shown in FIG. 15(*a*) and FIG. 15(*b*), the operation member 81 is made of a synthetic resin into a rectangular. At the lower end on the outside face of the center portion of this operation member 81, the operation rib 62 as an operation portion is formed to extend laterally. Besides, on both ends of the operation member 81, rectangular connection boards 84 are provided. These connection boards 84 are provided along the outside face of the operation member 81, and on the inside face (back face or rear face) side, each pair of engagement tubes 85 formed into a cylindrical shape is formed to protrude.

Figure 17:
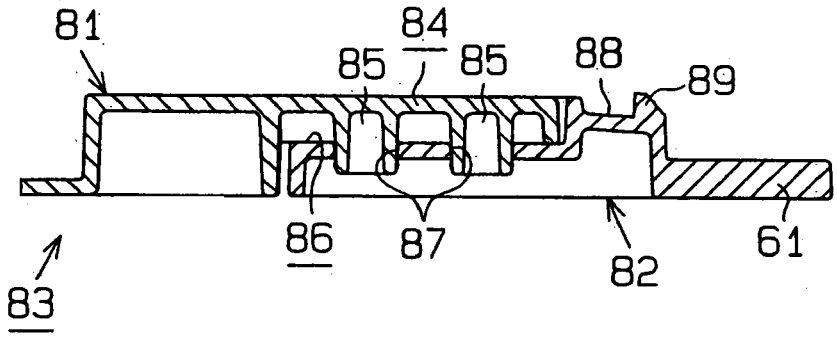
FIG. 17 is a partially enlarged sectional view showing part of an engagement member according to another embodiment.

As shown in FIG. 16(*a*) and FIG. 16(*b*), one connection member 82 connected to one end of the operation member 81 is made of a synthetic resin into a pole having a substantially rectangular cross-section, and further the engagement projection 61 is formed to protrude on its distal end. On outside face of the proximal end of this connection member 82, a rectangular connection recess 86 is formed to a predetermined depth recess, and when it is connected to one end of the operation member 81 as shown in FIG. 17, it is constructed so as to receive the connection board 84. In the center portion of this connection recess 86, a pair of left and right circular holes 87 is formed to penetrate, and when it is connected to one end of the operation member 81 as shown in FIG. 17, it is constructed so as to fit in the corresponding engagement tube 85.

As shown in FIG. 16(*b*), in the center portion of the connection member 82 between the connection recess 86 and the engagement projection 61, an attachment recess 88 is provided by forming its outside face to a predetermined depth recess. On the outside face of the distal end this attachment recess 88, an attachment projection 89 formed into a triangular pole shape is formed to protrude. Further, this attachment projection 89 is formed such that it becomes lower when it is nearer to the distal end side of the connection member 82.

In the center portion on the lower end face of the connection member 82, a lower portion biasing board 90 constituting biasing means extending obliquely downward toward the distal end of the connection member 82 is formed to protrude. In addition to the fact that this biasing board 90 is formed to extend at an angle of about 30° with respect to the lower end face of the connection member 82, it is constructed so as to be elastically deformable. Further, the other connection member connected to the other end of the operation member 81 is formed into a shape to be symmetrical in left and right with the above-mentioned one connection member 82.

Figure 18:
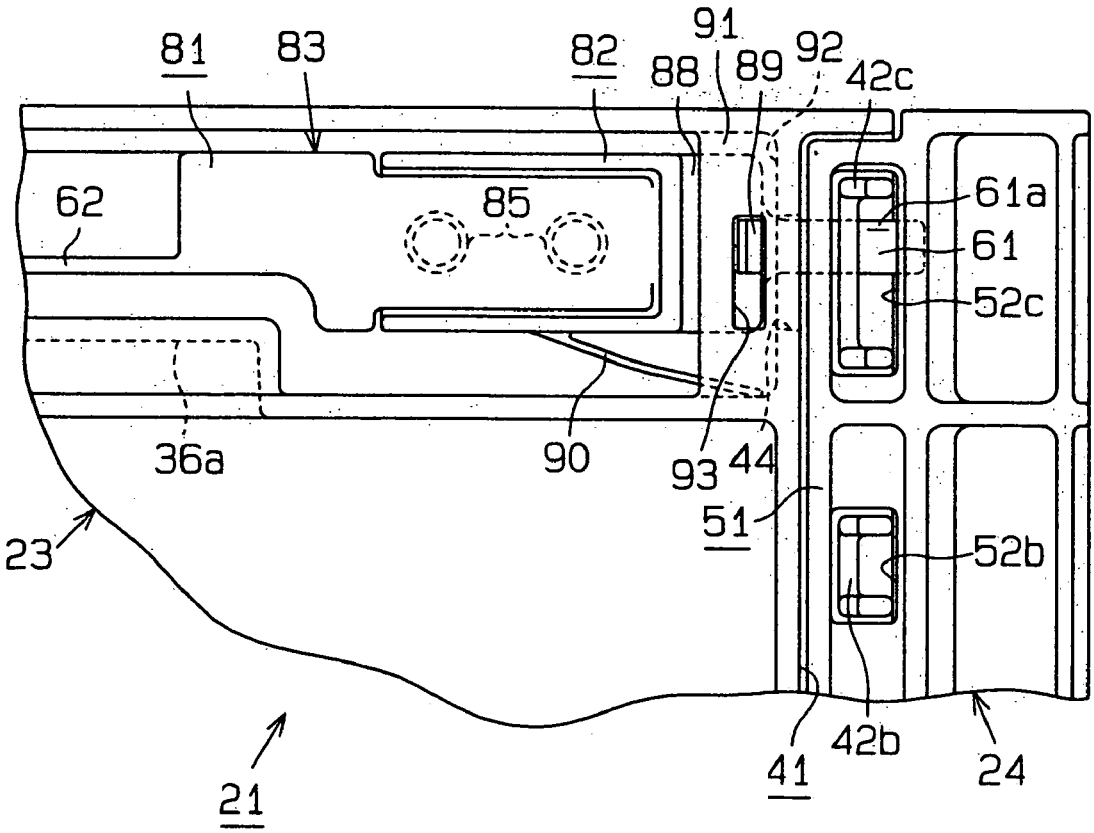
FIG. 18 is a partially enlarged side view showing part of a container body according to another embodiment.

On the other hand, as shown in FIG. 18, in the short side wall 23 to which the above engagement member 83 is attached, the side wall protrusion 45, the sliding engagement projection 46, and the long hole 46*a* in the above embodiment are omitted. Further, on the outer end of the side wall rib in which the second long hole 44 is formed, a rectangular attachment board 91 is provided to extend in an inner side direction of the short side wall 23. By this attachment board 91, the side wall rib, and the side wall ribs vertically adjacent to the rib, and the short side wall 23, a pair of attachment pockets 92 are formed on the outer side of the upper end of the short side wall 23. In addition, in the center portion of the attachment board 91 constituting this attachment pocket 92, an attachment sliding hole 93 extending vertically in a long hole shape is formed to penetrate.

And, when the engagement member 83 is attached to the outside face of the short side wall 23 of the container body 21, as shown in FIG. 18, first, the distal end of one connection member 82 is inserted in one attachment pocket 92, the engagement projection 61 is inserted in the first long hole 43 and the second long hole 44, and the attachment projection 89 is inserted to engage in the attachment sliding hole 93. Next, after the distal end of the other connection member is inserted in the other attachment pocket 92 likewise, by the operation member 81, the left and right connection members 82 are connected and fixed. At this time, each pair of engagement tubes 85 provided on both ends of the operation member 81 is inserted to fit in the circular holes 87 of the connection members 82, and the connection boards 84 at both ends of the operation member 81 are received in the connection recesses 86 of the connection members 82.

This engagement member 83 is constructed so that a pair of attachment projections 89 formed to protrude on its both ends outside face is slid with being guided vertically in the attachment sliding holes 93 of both ends of the short side wall 23, and it is capable of moving up and down retaining a predetermined width. Further, since the distal ends of a pair of lower portion biasing boards 90 formed to protrude on its both ends lower faces are in contact with the lower end of the attachment pocket 92 (the upper face of the side wall rib) constituting biasing means, this engagement member 83 is always biased upward. And, the container body 21 of this foldable transportation container can be folded and assembled in entirely the same manner as the above embodiment.

In such a construction, since the assembling operation of parts after injection molding, in particular, since the attaching operation of the engagement member 83 to the outside face of the short side wall 23 can easily be performed, the manufacture of the container body 21 can easily be performed.

In the engagement member 83 shown in FIG. 15 to FIG. 18, it is constructed so that one connection member 82 or the other connection member may be molded integrally with the operation member 81 (injection molding as one part). In case of constructing the engagement member in this manner, in addition to the fact that the manufacture of the container body 21 can easily be performed, the number of parts constituting the engagement member 83 can easily be reduced.

In the foldable transportation container shown in FIG. 15 to FIG. 18, in place of forming the lower portion biasing boards 90 to protrude on the lower faces of one connection member 82 and the other connection member, it may be constructed so that it may be formed to protrude on the upper face of the side wall rib with which the distal end of the lower portion biasing board 90 is in contact.

Figure 19A:
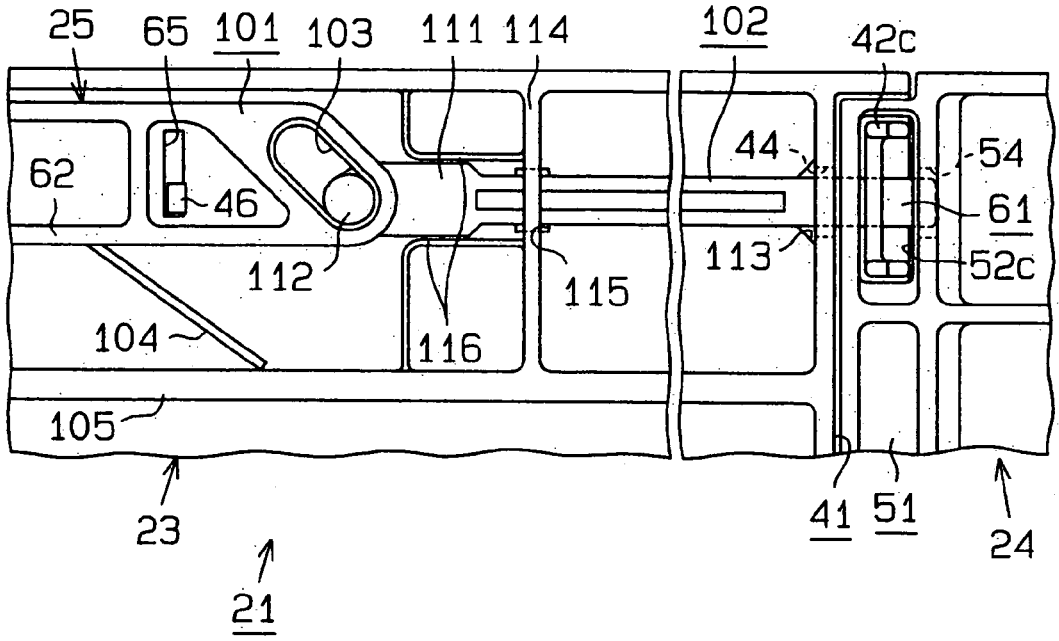
FIGS. 19(*a*) and 19(*b*) are partially enlarged side views showing part of the container body of a foldable transportation container according to another embodiment.
Figure 19B:
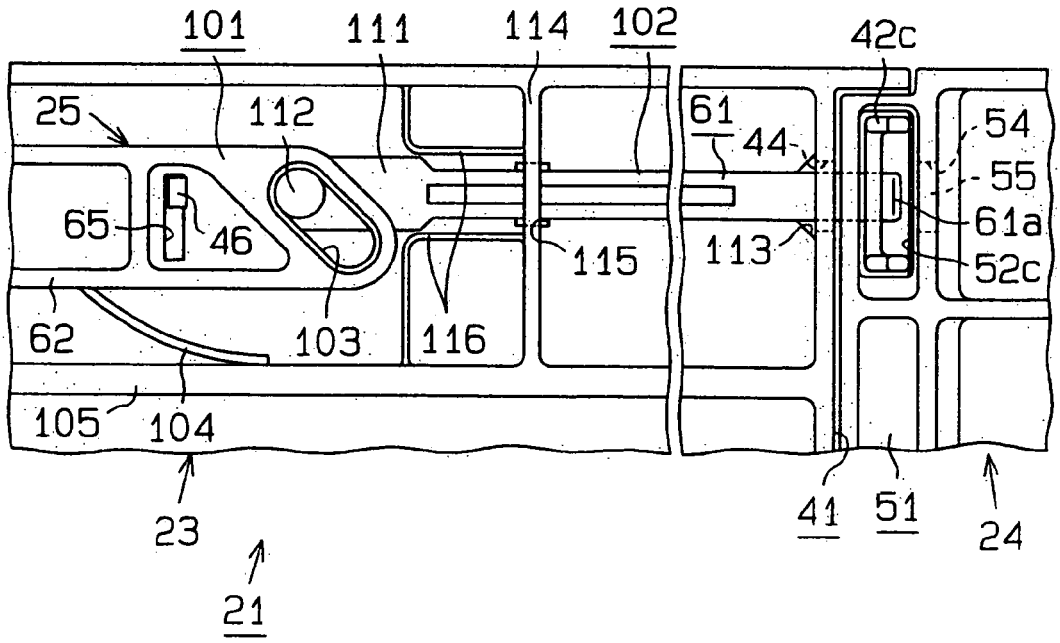

As shown in FIG. 19(*a*) and FIG. 19(*b*), the engagement member 25 should be constituted by three parts molded into separate bodies, that is, a vertical sliding member 101, and a pair of left and right horizontal sliding members 102 provided on both ends of the vertical sliding member 101. Further, sliding conversion means for transmitting the vertical sliding of the vertical sliding member 101 to the horizontal sliding members 102 with converting into vertical sliding is provided between both ends of the vertical sliding member 101 and the proximal ends of the horizontal sliding members 102.

In addition to the fact that the vertical sliding member 101 is formed into a side face trapezoidal shape (a substantially rectangular shape), its both edges are formed into a taper shape narrowing upward. On the outside face of the center portion of this vertical sliding member 101, the operation rib 62 extending laterally is formed to protrude, and it is possible to easily press downward the vertical sliding member 101. In both ends of this vertical sliding member 101, a pair of left and right sliding engagement holes 103 constituting sliding conversion means formed into a long hole shape extending obliquely upward along edges of the vertical sliding member 101 is formed to penetrate. At the middle position between the sliding engagement holes 103 and the operation rib 62, a pair of left and right sliding engagement holes 65 is formed to penetrate into a long hole shape extending vertically, and engaged with the corresponding sliding engagement projection 46 formed to protrude on the outside face of the short side wall 23, and attach the vertical sliding member 101 so as to be vertically movable along the outside face of the short side wall 23.

Further, in the center of the lower end of this vertical sliding member 101, a pair of left and right biasing boards 104 constituting biasing means are formed to protrude. These biasing boards 104 in a pair are formed to protrude so as to extend obliquely downward from the center portion of lower face of the vertical sliding member 101. Further, the lower ends (the distal ends) of these biasing boards 104 are in contact with the upper face of a lateral rib 105 constituting biasing means formed to protrude so as to extend laterally on the outside face of the short side wall 23, and always biases upward the vertical sliding member 101.

On the distal end of the horizontal sliding member 102, the engagement projection 61 formed into a long bar shape extending horizontally is provided, and inserted to engage so as to be engageable/disengageable in the engagement recess 54 as an engagement portion as shown in FIG. 14(*a*) and FIG. 14(*b*). On the proximal end of this horizontal sliding member 102, a board-shaped portion 111 constituting a sliding guide portion formed into a substantially rectangular board shape is provided. The upper and lower end faces of this board-shaped portion 111 are each constituted by a flat face extending along a horizontal plane. On one end outer face of this board-shaped portion 111, a circular protrusion 112 formed into a side face circular shape as a sliding engagement protrusion constituting sliding conversion means is formed to protrude so as to extend outward, and inserted to engage so as to be slidable in the sliding engagement hole 103 of the vertical sliding member 101.

Further, in the back faces of the second long holes 44 of both ends of the short side wall 23, attachment holes 113 formed into a side face triangular shape are formed by punching, and constructed so as to be easily attached to the distal end of the horizontal sliding member 102 (the engagement projection 61) formed into a separate body to the predetermined position on the outside face of the short side wall 23. On the other hand, on the outside faces of the short side walls 23 positioning in both side directions of the vertical sliding member 101, a pair of left and right upper portion ribs 114 extending vertically are formed to protrude. Further, on the back face of the center portion of the upper portion rib 114, a second attachment hole 115 constituting a sliding guide portion is provided by forming to penetrate the wall face of the short side wall 23 into a rectangular hole shape, and thus it is constructed so as to easily attach the proximal end of the horizontal sliding member 102 (the board-shaped portion 111) to the outside face of the short side wall 23.

Further, the second long hole 44 constitutes a sliding guide portion for horizontally sliding the engagement projection 61 of the horizontal sliding member 102. Further, at upper and lower ends of the upper portion rib 114 in the inner side direction, a pair of upper and lower stopping ribs 116 constituting a sliding guide portion formed into a side face L-shape for stopping the board-shaped portion 111 is formed to protrude such that it extends outward from the outside face of the short side wall 23 so as to be horizontally slidable. The lower end face of the stopping rib 116 positioning upward and the upper end face of the stopping rib 116 positioning downward are each constituted by a flat face extending along a horizontal plane.

In addition, the outer side of the distal end of the engagement projection 61 is preferably constructed with the second slanting face 61*a* such that it is formed to slant in an inner side direction of the container body 21 nearer to the distal end. In addition, along the edge of the back face of the engagement portion 55 (the side face on the inner direction side of the container body 21), the slanting face 55*a* is preferably formed so as to slant outward of the container body 21 nearer to the end side.

By the way, in the container body 21 of this foldable transportation container, since the distal ends of a pair of left and right biasing boards 104 provided on the lower end of the vertical sliding member 101 are in contact with the upper face of the lateral rib 105, the vertical sliding member 101 is always biased upward. Further, since a pair of left and right horizontal sliding members 102 are connected to the vertical sliding member 101 by an engagement relation between the sliding engagement hole 103 and the circular protrusion 112, they are always biased outward of the short side wall 23 as shown in FIG. 19(*a*). Therefore, the distal ends of a pair of left and right engagement projections 61 are inserted to engage in the engagement recess 54 and the short side wall is not folded inside the container body 21.

And, this foldable transportation container is slid downward along the sliding engagement hole 65, by pressing downward the operation rib 62 shown in FIG. 19(*a*) against the biasing force of the biasing board 104, as shown in FIG. 19(*b*), with the vertical sliding member 101 pulling the left and right horizontal sliding members 102. At this time, a pair of left and right horizontal sliding members 102 slide horizontally in inner side directions of the short side wall 23 in accordance with the down movement of the vertical sliding member 101, an engagement state between the distal end of the engagement projection 61 and the engagement recess 54 is released, and the short side wall 23 is in a state of being foldable inside the container body 21. Further, when the container body 21 is assembled, after a pair of opposing long side walls 24 are placed on the supporting protrusion 31*b*, the engagement projection 61 and the engagement portion 55 can semi-automatically be made to be engaged by placing a pair of opposing short side walls 23 on the supporting protrusion 31*a*.

In the case where the container is constructed as described above, a pair of left and right engagement projections 61 are horizontally slid toward inner side directions of the short side wall 23, and the distal end of the engagement projection 61 is drawn out from the interior of the engagement recess 54 by moving down the operation rib 62 (the vertical sliding member 101), as shown in FIG. 19(*b*). As a result, an engagement state between the engagement projection 61 and the engagement portion 55 is released, and the short side walls 23 are folded inside the container body 21. Therefore, by the above construction, the folding operation of the container body 21 can be performed very easily.

The limiting protrusions 42*a*, 42*b*, and 42*c* should be constructed so as not to be inserted to engage in the limiting holes 52*a*, 52*b*, and 52*c*. Further, an unillustrated second limiting board constituting limiting means formed into a rectangular shape extending vertically and extending in an inner side direction of the container body 21 is formed to protrude on the distal end of the limiting board 51, and when the container body 21 is assembled, it is constructed so as to be in contact with one side walls of the limiting protrusions 42*a*, 42*b*, and 42*c*. Note that, at this time, the limiting protrusions 42*a*, 42*b*, and 42*c* need not be formed into a U-shaped side face, and for example, may be formed into a rectangular board shape extending outward from the outside face of the engagement recess 41.

In such a construction, when the container body 21 is assembled, the long side wall 24 can easily be limitd such that the container body 21 may not fall outside by bringing the limiting protrusions 42*a*, 42*b*, and 42*c* into contact with the second limiting board. In addition, at this time, the construction of the container body 21 of the foldable transportation container can easily be simplified.

What is claimed is:

1. A foldable transportation container comprising:

a container body having a rectangular bottom wall, a pair of first side walls, and a pair of second side walls, wherein the first and second side walls are provided along the periphery of the bottom wall, each of the side walls includes a lower end and an outer surface and, the bottom wall includes an upper face;

rotating means provided on the lower ends of the first and second side walls, the rotating means permitting the first and second side walls to be folded inward of the container body, wherein the first side walls are folded onto the upper face of the bottom wall and then the second side walls are folded onto the folded first side walls;

an engagement members provided on the outer surface of each first side wall, wherein an operation portion is provided on the substantial center of each engagement member, and wherein a projection is provided at each end of each engagement member; and engagement portions provided on both ends of the second side walls, wherein the engagement portions are engaged with the engagement projections to limit rotation of the first side walls inward of the container body, and wherein the operation portions of the engagement members are moved up or down, which moves the engagement projections up and down in correspondence therewith, to release engagement between the engagement projections and the engagement portions.

2. The foldable transportation container according to claim 1, further comprising biasing means located on the first side walls and the engagement members, wherein the biasing means biases the engagement projections in predetermined directions to maintain engagement between the engagement projections and the engagement portions.

3. The foldable transportation container according to claim 1, wherein the engagement projections are disengaged from the engagement portions by moving the operation portions downward.

4. The foldable transportation container according to claim 1, wherein each second side wall is provided on its both ends with limiting boards for limiting the outward rotation of the first side walls.

5. The foldable transportation container according to claim 4, wherein limiting means for limiting outward rotation of the second side walls is provided between the limiting boards and the ends of the first side walls.

6. The foldable transportation container according to claim 1, wherein each engagement projection has a slanting face at a portion that contacts the corresponding engagement portion.

7. The foldable transportation container according to claim 1, wherein each engagement portion has a slanting face at a portion that contacts the corresponding engagement projection.

8. The foldable transportation container according to claim 1, wherein a handle portion for holding the container body is provided near each operation portion, and each operation portion can be operated with a hand holding the corresponding handle portion.

9. The foldable transportation container according to claim 1, wherein each operation portion is provided at the lateral center of the corresponding first side wall.

10. The foldable transportation container according to claim 1, wherein the movement of the operation portions of the engagement members is limited within a predetermined range.

11. The foldable transportation container according to claim 1, wherein the container body and the engagement members are made of an elastically deformable synthetic resin.

* * * * *

UNITED STATES PATENT AND TRADEMARK OFFICE

CERTIFICATE OF CORRECTION

PATENT NO. : 7,195,128 B2
APPLICATION NO. : 11/006178
DATED : March 27, 2007
INVENTOR(S) : Murakami et al.

It is certified that error appears in the above-identified patent and that said Letters Patent is hereby corrected as shown below:

Title page, insert the following:
(30) Foreign Application Priority Data
May 21, 2001 (JP) .....2001-150717
January 10, 2002 (JP) .....2002-003739

Signed and Sealed this

Twentieth Day of May, 2008

JON W. DUDAS
*Director of the United States Patent and Trademark Office*